US006557382B1

(12) United States Patent
Koike et al.

(10) Patent No.: US 6,557,382 B1
(45) Date of Patent: May 6, 2003

(54) WASHING MACHINE

(75) Inventors: Toshifumi Koike, Chiyoda (JP); Yoshihiro Ohta, Kukizaki (JP); Yosuke Nagano, Hitachi (JP); Tamotu Shikamori, Juuou (JP); Hiroshi Ohsugi, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 153 days.

(21) Appl. No.: 09/666,610

(22) Filed: Sep. 20, 2000

(30) Foreign Application Priority Data

Sep. 20, 1999 (JP) ..... 11-265012

(51) Int. Cl.[7] ..... D06F 39/20

(52) U.S. Cl. ..... 68/17 R; 68/13 A; 68/207

(58) Field of Search ..... 134/56 D, 57 D, 134/58 D, 95.1, 98.1; 68/17 R, 13 A, 207; 137/624.18; 222/651

(56) References Cited

U.S. PATENT DOCUMENTS

| | | | | |
|---|---|---|---|---|
| 2,077,857 | A | * | 4/1937 | Seaton |
| 2,514,050 | A | * | 7/1950 | Grebe |
| 2,825,666 | A | * | 3/1958 | Stoddard |
| 3,087,504 | A | * | 4/1963 | Geschka |
| 3,148,687 | A | * | 9/1964 | Dosch |
| 3,204,767 | A | * | 9/1965 | Borochaner |
| 3,339,737 | A | * | 9/1967 | Kiscellus et al. |
| 3,363,637 | A | * | 1/1968 | Rumbaugh et al. |
| 3,385,441 | A | * | 5/1968 | Lyall |
| 3,386,454 | A | * | 6/1968 | Kendt |
| 3,496,740 | A | * | 2/1970 | Borochaner |
| 3,530,691 | A | * | 9/1970 | Borochaner |
| 3,680,703 | A | * | 8/1972 | Borochaner |
| 4,090,963 | A | * | 5/1978 | Grout |
| 4,121,903 | A | * | 10/1978 | Smolka |
| 4,144,093 | A | * | 3/1979 | Reinwald et al. |
| 4,164,430 | A | * | 8/1979 | Reinwald et al. |
| 4,307,742 | A | * | 12/1981 | Scrott |
| 4,434,629 | A | * | 3/1984 | Bianchi et al. |
| 4,732,171 | A | * | 3/1988 | Milocco |
| 5,185,379 | A | * | 2/1993 | Milocco et al. |

FOREIGN PATENT DOCUMENTS

| | | | |
|---|---|---|---|
| DE | 1585797 | * | 9/1972 |
| DE | 2219888 | * | 10/1973 |
| DE | 2346801 | * | 4/1974 |
| DE | 2742914 | * | 3/1978 |
| DE | 3925054 | * | 1/1991 |
| DE | 4023315 | * | 1/1992 |
| DE | 4238450 | * | 5/1994 |

OTHER PUBLICATIONS

European Patent Application 003,451 Aug. 1979.*
European Patent Application 0146,184 Jun. 1985.*
European Patent Application 612,495 Jan. 1984.*

* cited by examiner

*Primary Examiner*—Frankie L. Stinson
(74) *Attorney, Agent, or Firm*—Antonelli, Terry, Stout & Kraus, LLP

(57) ABSTRACT

An ion removes provided between a feed water valve for supplying water to an outer tub and a detergent supply case and an upper portion from the outer tub includes a cylindrical vessel in which sodium type strong acid positive ion exchange resin is filled up, a salt water vessel provided above the cylindrical vessel, and a salt vessel provided in the salt water vessel for receiving salt to enable plural regeneration of an ion exchange resin. Salt from the salt vessel is dissolved in water supplied to the salt water vessel and salt water having a concentration of about 10% is generated. After completion of every washing feed water cycle and every rinsing feed water cycle with an interval, the salt water is caused to flow into the ion exchange resin and the ion exchange resin is automatically regeneration-processed.

4 Claims, 13 Drawing Sheets

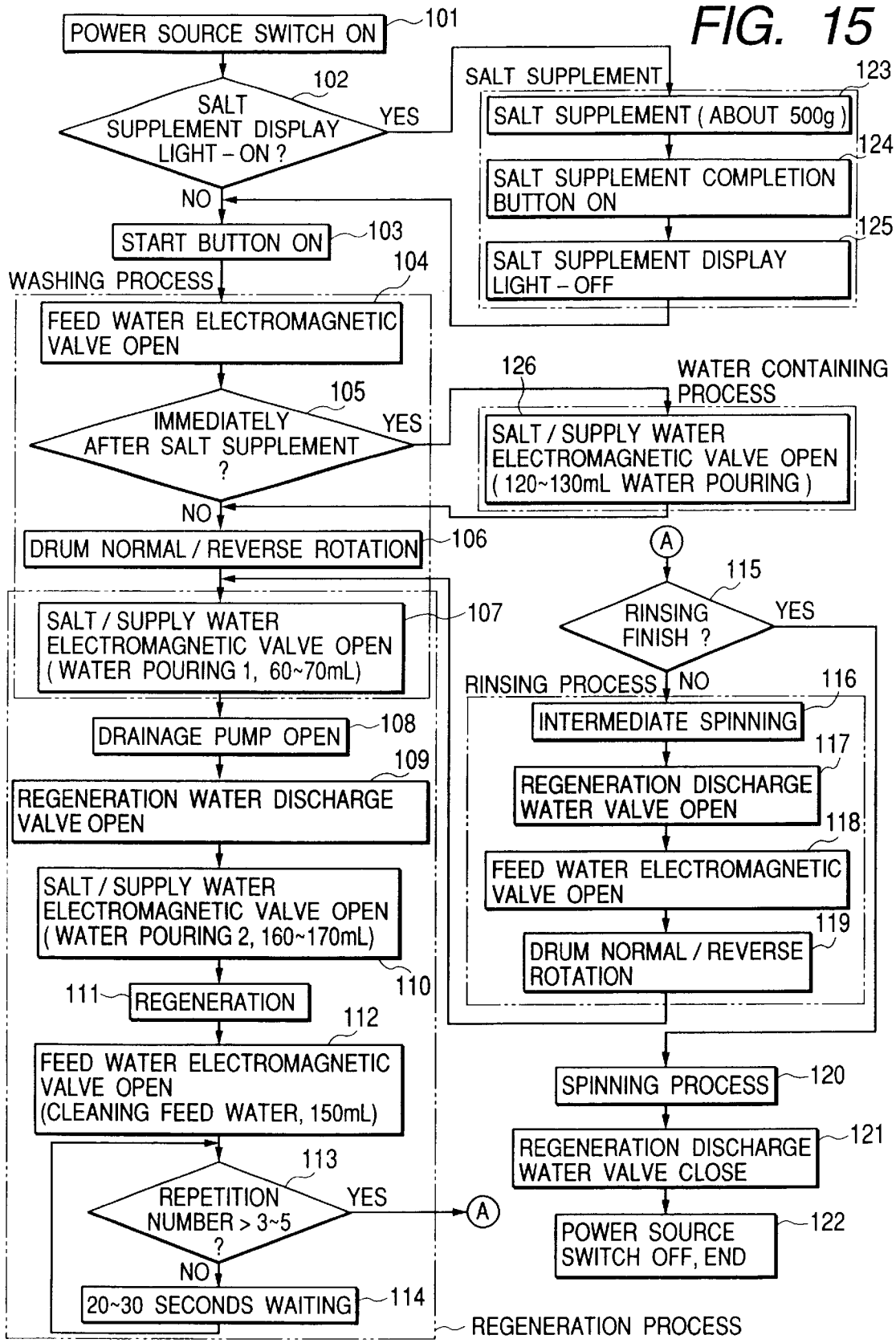
FIG. 15
POWER SOURCE SWITCH ON
101
SALT SUPPLEMENT DISPLAY LIGHT - ON ?
102
YES
NO
START BUTTON ON
103
WASHING PROCESS
104
FEED WATER ELECTROMAGNETIC VALVE OPEN
IMMEDIATELY AFTER SALT SUPPLEMENT ?
105
YES
NO
DRUM NORMAL / REVERSE ROTATION
106
SALT / SUPPLY WATER ELECTROMAGNETIC VALVE OPEN ( WATER POURING 1, 60~70mL)
107
DRAINAGE PUMP OPEN
108
REGENERATION WATER DISCHARGE VALVE OPEN
109
SALT / SUPPLY WATER ELECTROMAGNETIC VALVE OPEN ( WATER POURING 2, 160~170mL)
110
REGENERATION
111
FEED WATER ELECTROMAGNETIC VALVE OPEN (CLEANING FEED WATER, 150mL)
112
REPETITION NUMBER > 3~5 ?
113
YES
NO
20~30 SECONDS WAITING
114
REGENERATION PROCESS
SALT SUPPLEMENT
SALT SUPPLEMENT ( ABOUT 500g )
123
SALT SUPPLEMENT COMPLETION BUTTON ON
124
SALT SUPPLEMENT DISPLAY LIGHT - OFF
125
126
WATER CONTAINING PROCESS
SALT / SUPPLY WATER ELECTROMAGNETIC VALVE OPEN ( 120~130mL WATER POURING )
A
RINSING FINISH ?
115
YES
NO
RINSING PROCESS
INTERMEDIATE SPINNING
116
REGENERATION DISCHARGE WATER VALVE OPEN
117
FEED WATER ELECTROMAGNETIC VALVE OPEN
118
DRUM NORMAL / REVERSE ROTATION
119
SPINNING PROCESS
120
REGENERATION DISCHARGE WATER VALVE CLOSE
121
POWER SOURCE SWITCH OFF, END
122

WASHING MACHINE

BACKGROUND OF THE INVENTION

The present invention relates to a washing machine which has means for removing a hardness component from the water which is used for the washing.

It is known that divalent positive ions, such as calcium ions and magnesium ions, have a large affect on the detergency of a detergent, since they act as a hardness component. Since these ions react with a surfactant to generate a water insoluble metallic soap, the contribution of the surfactant is reduced and the detergency is lowered. In a synthetic detergent, in order to reduce the hardness, a zeolite as one of the builders is blended. The zeolite is a minute white color particle in which silicic acid and aluminum form main components, and a sodium ion in the zeolite and polyvalent positive ions, such as the calcium ions and the magnesium ions, in the water perform an ion-exchange, so that the water is softened. However, while the zeolite removes the polyvalent positive ions, since these polyvalent positive ions react with the surfactant of the detergent, the generation of the metallic soap can not prevented completely. It is preferable to perform the washing by dissolving the detergent in water from which the ions have already been removed. Further, since the zeolite mingles with the detergent, there is a problem in that the zeolite particles adhere to the clothes after the washing.

A washing machine in which these metal ions are removed before the washing is carried out is described in Japanese application patent laid-open publication No. Hei 11-151397. In this washing machine, a hardness judgement means is provided for judging the hardness of the water, and a water softening means is used to produce soft water from the hard water. Further, in this washing machine, in addition to the water softening means, a regeneration mechanism is provided for regenerating the positive ion exchange resin which is used in the water softening means. This regeneration means is constituted by a salt supply means for supplying the salt which is used for the regeneration of the positive ion exchange resin and a water discharge passage for discharging the water from the positive ion exchange resin to the outside of the washing machine during the regeneration. Further, in detail, a salt case is provided in which a salt solution liquid or a common salt is accommodated in advance, and from this salt case, a one time part salt solution liquid or a one time part common salt is discharged, and the salt solution liquid or the common salt is supplied to a water softening portion along with the water which passes through the feed water passage, whereby the positive ion exchange resin is regenerated.

In the washing machine according to the above-stated technique, when the hardness of city water exceeds the water softening ability of the positive ion exchange resin, by reducing the amount of water used for the washing, the effectiveness of the detergent is increased, up and the washing is carried out over a longer period of time; however, full consideration has not been given to the formation of the soft water when the water hardness is very high.

Further, although consideration is given to the softness of the water for preventing a drop in the cleaning effect of the detergent, no consideration has been given to the formation of soft water for use in rinsing and the effects thereof. In this regard, the hardness component has a unfavorable affect on rinsing. The rinsing is carried out to exclude the dirty components, which are removed from the clothes by the washing, so that they will not adhere again to the clothes, and further to remove the detergent which is adsorbed on the clothes. The surfactant in the detergent which is adsorbed on the clothes is diluted by the rinsing water and is separated from the clothes. At this time, in rinsing water which contains a large water hardness component, the hardness component and the surfactant are combined, so that a metallic soap is formed. When the surfactant is adsorbed on the clothes and the metallic soap is formed, it is difficult to remove the metallic soap.

Accordingly, after the rinsing, the metallic soap still adheres to the clothes, and the feeling of the clothing becomes bad (a stiff feeling), and the wearing of the clothes feeling.

For example, generally in Europe and the United States of America a, the water has very high hardness compared to the water in Japan.

More particularly, in a drum type washing machine which is the main type of machine used in Europe, by using hot water, a reduction in the cleaning ability is prevented. However, to raise the temperature of the water, it is necessary to use much electric power. For example, to raise 30 liters of water from 20° C. to 60° C., when the adiabatic is performed perfectly, it is necessary to use about 1.4 kWh of electric power. This means that with respect to the consumption of electric power for the washing alone using the water, heating the water requires about ten times the amount of electric power. Recently, to prevent global warming, it is required to perform energy saving in the operation of electrical products. For these reasons, in a drum type washing machine, it is desirable to lower the temperature of the washing water. For this purpose, it is necessary to heighten the detergency in a way other than by the use of hot water.

SUMMARY OF THE INVENTION

A first object of the present invention is to provide a washing machine wherein, although water having a high hardness may be used, a high cleaning effect can be obtained.

Further, a second object of the present invention is to provide a washing machine wherein, in addition to a heightening of the cleaning effect using a detergent, the washing performance, including rinsing, can be improved.

To attain the above-stated first object, in a washing machine having a washing tub for receiving objects to be washed and for carrying out a washing of these objects, a feed water device is provided for supplying water to the washing tub, and a drainage means is used for discharging water from an inner portion of the washing tub. The washing machine is characterized in that the feed water means comprises a feed water valve, a vessel for injecting a detergent on a downstream side of the feed water valve, and an ion removal means for removing ions which are contained in the feed water, the ion removal means being provided between the feed water valve and the detergent injecting vessel.

Using a control means for controlling the washing process, in the supply of water during the washing process, the water supply is interrupted once, the washing process is carried out to a midway point in the cycle, after which the water supply is started again and water is supplied in a regular amount.

Further, to attain the above-stated second object, after completion of the washing process, the ion removal means is regenerated, and, in a rinsing process, soft water in which the ions are removed is supplied.

As the above-stated ion removal means, an ion exchange material is used, while in a regenerating process, a regeneration processing agent is used, and the ion exchange function of the ion exchange material is regenerated. Further, as the regeneration processing agent, for example, salt or salt water can be used. However, to make the ion removal means compact, it is preferable to store the salt or the water each time the regeneration is performed, and to produce the salt water in the case of the use salt water.

BRIEF DESCRIPTION OF DRAWINGS

FIG. 15 is an operation flow chart of the drum type washing machine in FIG. 1;

DESCRIPTION OF THE INVENTION

Hereinafter, a washing machine representing one embodiment according to the present invention will be explained with reference to the drawings.

Figure 1:
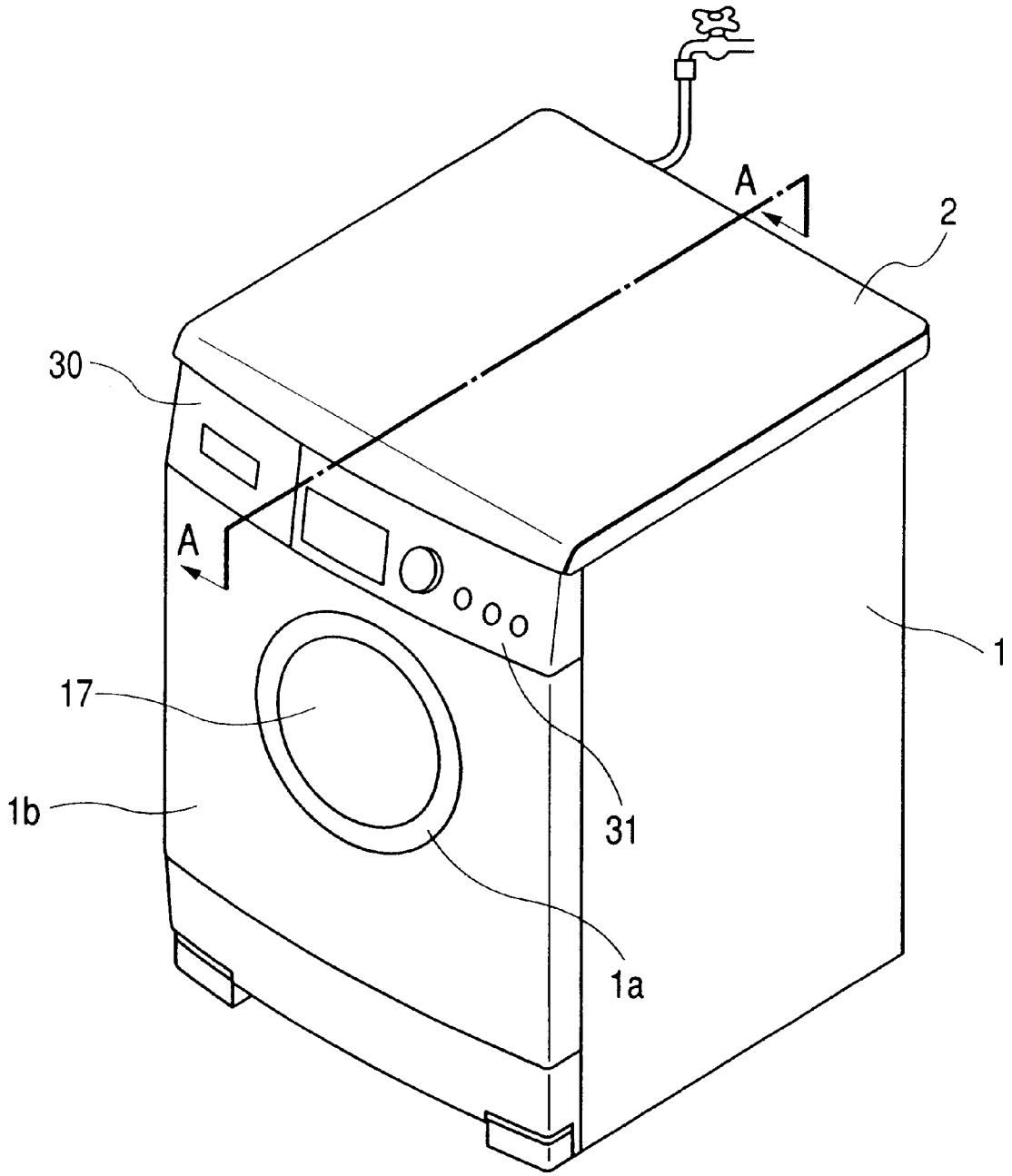
FIG. 1 is perspective view of a drum type washing machine according to the present invention.
Figure 2:
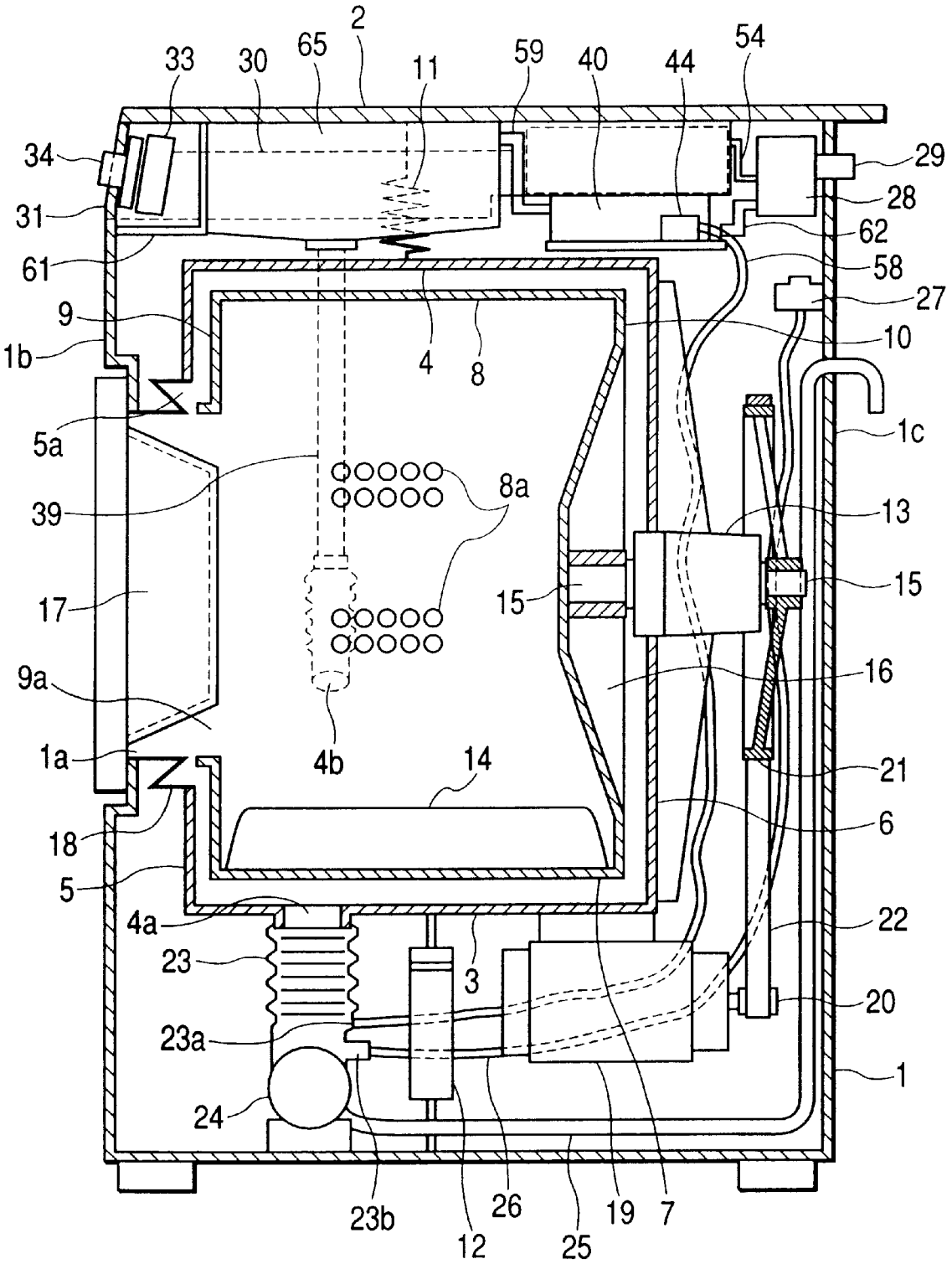
FIG. 2 is a longitudinal cross-sectional view taken along line A—A in FIG. 1.

FIG. 1 is a view showing the outer appearance of a drum type washing machine representing one embodiment according to the present invention, and FIG. 2 is a longitudinal cross-sectional view taken along line A—A of FIG. 1.

The drum type washing machine is constituted such that, in an outer frame 1, an outer tub 3 is buffer-supported (vibration prevention-supported) through a vibration prevention spring member 11 (a tensile coil spring member) and a friction damper 12, etc. In a central portion of a front face 1*b* of the outer frame 1, a clothes access port 1*a* is formed, and at an upper portion of the housing 1, a top plate 2 is provided.

The outer tub 3 is constituted by a cylindrical body portion 4 and side plates 5 and 6, and during washing and rinsing, the washing water and the rinsing water are received in this outer tub 3. To a lower portion of the cylindrical body 4, a drainage port 4*a* is provided, and to a central portion of the side plate 5 an access 5*a* for the clothes is formed. To a lower portion of the drainage port 4*a,* a drainage pump 24 is connected through a drainage bellows 23, and to a drainage portion of the drainage pump 24, a drainage hose 25 is connected. The drainage hose 25 extends through an opening in the rear face 1*c* of the outer frame 1 outside of the washing machine and is connected to a drainage pipe (not shown in drawing). To a lower portion 23*b* of the drainage pump 24, a pressure hose 26 is installed, and the other end of the pressure hose 26 is connected to a water level sensor 27, which is provided on the upper portion of the outer frame 1.

A drum 7, which serves as a washing tub and a spinning tub, is constituted by a cylindrical body portion 8 and side circular plates 9 and 10. The drum 7 is supported horizontally by a cylindrical bearing member 13 which is fixed to a central portion of the side plate 6 of the outer tub 3 and is received rotatively in the inner portion of the outer tub 3. Over the whole periphery of the cylindrical body 8, many small holes 8*a* are provided, which function as spinning holes and have a diameter of 4–5 mm. In the inner portion, plural lifters 14 are installed, which stir the clothes during washing. At a central portion of the side circular plate 9, a clothes access port 9*a* is formed, and to the side circular plate 10, a hub 16, in which a drum drive shaft 15 is mounted integrally, is fixed.

A lid 17, which is constituted by a bowl-shaped glass window etc., is provided to cover the access port 1*a,* which is formed on the outer frame 1, and is designed to obstruct the flow-out of water in the outer tub 3 as a result of close contact with the bellows 18. During operation, the lid 17 is closed by operating a lid lock (not shown in drawing), which is provided with a solenoid and the like to prevent machine operation while the lid is open. The clothes are placed into and taken out of the drum 7 through the port 1*a* by opening and closing the above-stated lid 17. The bellows 18 is formed with an elastic rich rubber or the like and connects in a water-sealing manner or softly the opening (the access port 1*a*) of the outer frame 1 and the opening (the access port 5*a*) of the outer tub 3.

A drive portion for rotating and driving the drum 7 is constituted by a variable speed type motor 19, such as a communicator motor, an inverter motor, or a direct current motor etc., a small size pulley 20 fastened to a shaft of the motor 19, a large size pulley 21 fastened to the drum drive shaft 15, and a belt 22 which extends between both pulleys. During the washing operation and the rinsing operation, the drum 7 is rotated normally and reversibly, for example at about 50 rpm, and a spinning operation, at first the drum 7 is rotated at a lower speed of about 120 rpm, and then the drum 7 is rotated at a high speed at a regular spinning rotation number of about 900 rpm.

To the upper portion of the outer frame 1, feed water components, such as an electromagnetic valve 28, an ion removal means 40, a water reservoir 65 and the like are provided. On a side of a front face of the upper portion, an operation box 61 is provided for receiving electric components, such as a microprocessor and the like. To a bottom face of the water reservoir 65, a pour water pipe 39 is connected and another end of the pour water pipe 39 is connected to the cylindrical body portion 4 of the outer tub 3.

Figure 3:
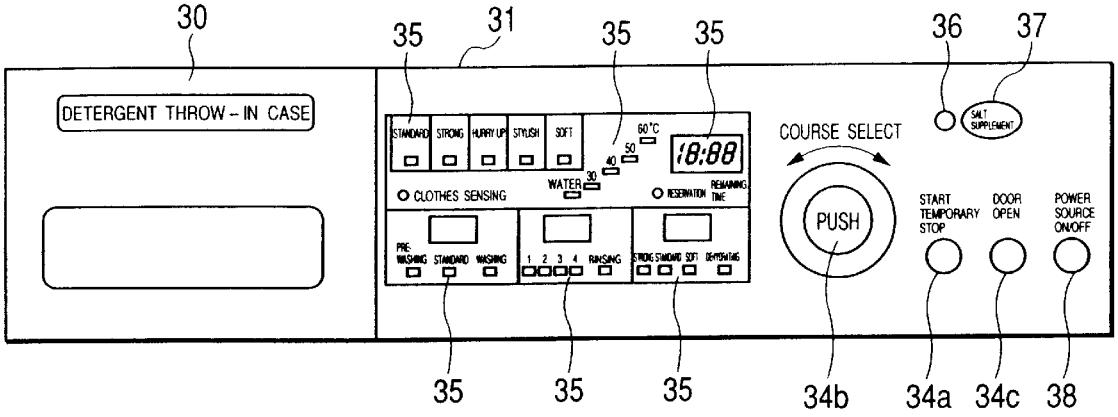
FIG. 3 is a diagram of an operation panel of the drum type washing machine of Fig. 1.

At a front face of the operation box 61, an operation panel 31, as shown in FIG. 3, is installed, and in the operation box 61, a control circuit 33, which has a microprocessor forming the main element of the control unit, is installed. On the operation panel 31, a power source switch 38, various kinds of indication means 35, various kinds of operation buttons 34, a buzzer (not shown in the drawing) etc. are arranged, and an operator operates the washing machine using the operation buttons 34. Further, the operator can confirm the operation conditions by the indication means 35. The operation panel also has a salt supplement indication means 36, which provides an alarm and displays an indication of the need for supplement of the salt which is used to effect regeneration of the ion removal means 40, and a salt supplement finish button 37 for turning off the salt supplement indication means 36 after the supplement of the salt is completed.

In parallel to the operation panel 31, a detergent supply case 30 for supplying the detergent and a fabric softener is provided. The detergent supply case 30 is provided in the water reservoir 65 so that the case 30 can be taken out of the water reservoir 65 so that the detergent and the fabric softener can be placed therein.

Figure 4:
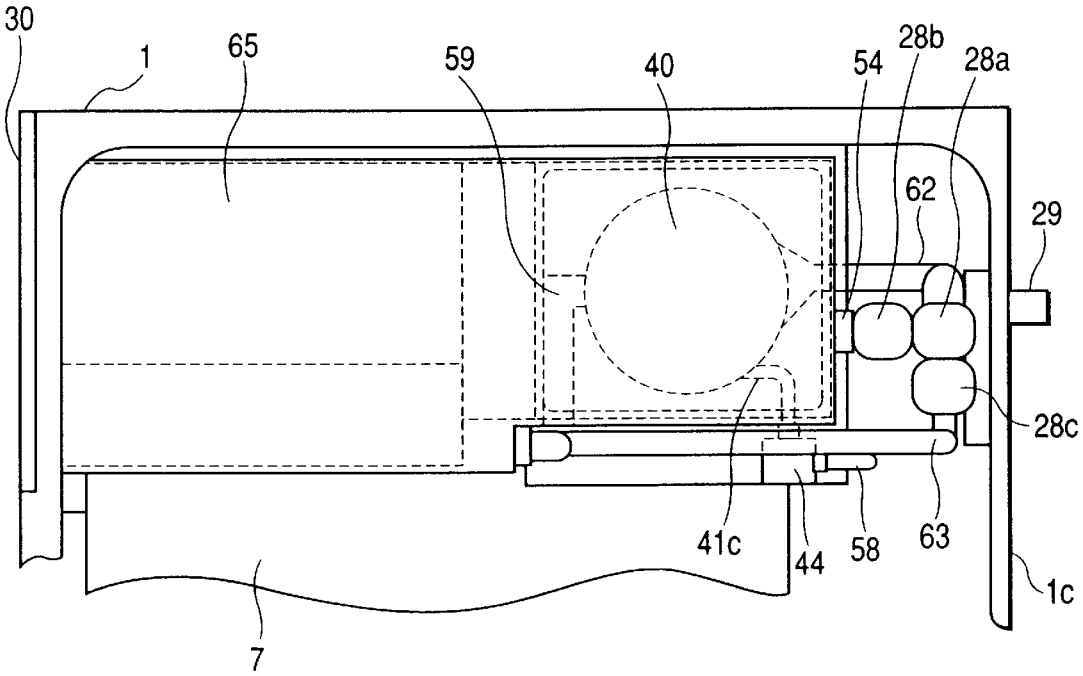
FIG. 4 is a top plane view of a feed water component receiving portion of the drum type washing machine of Fig. 1.

FIG. 4 is a top plan view showing a feed water component in a case where the top plate 2 has been taken off. To the upper portion of the rear face 1*c* of the outer frame 1, a city water faucet port 29, to which a feed water hose is connected from the city water supply, is provided. The city water faucet port 29 is connected to the electromagnetic valve 28. The electromagnetic valve 28 is a triple valve, which is comprised of a feed water electromagnetic valve 28*a*, a salt / feed water electromagnetic valve 28*b*, and a fabric softener / feed water electromagnetic valve 28*c*. Adjacent to the feed water electromagnetic valve 28*a*, the ion removal means 40 and the pour water reservoir 65 are provided. The feed water electromagnetic valve 28*a* is connected to the ion removal means 40 through a feed water pipe 62. The salt / feed water electromagnetic valve 28*b* is connected to the ion removal means 40 through a feed water pipe 54. The fabric softener electromagnetic valve 28*c* is connected to the water reservoir 65 through a feed water pipe 63. The ion removal means 40 and the water reservoir 65 are connected by a feed water pipe 59. As stated above, since the ion removal means 40 is installed between the electromagnetic valve 28 and the water reservoir 65 and is adjacent to both members, the water supply passage for connecting these members can be short. Accordingly, the piping resistance of the water supply passage can be lessened and a reduction of the water pressure can be prevented. Further, the water supply components can be arranged compactly.

Figure 5:
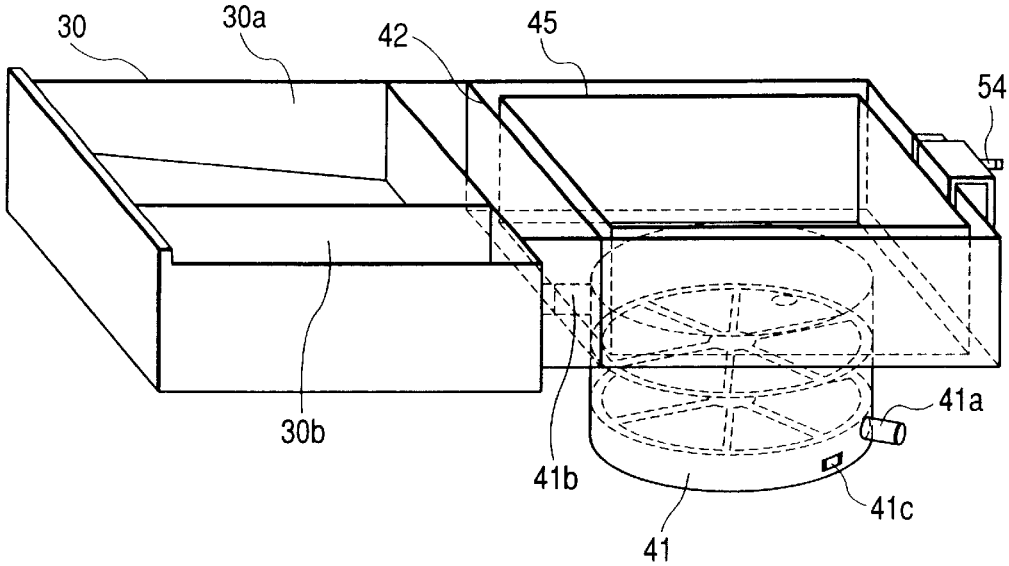
FIG. 5 is a perspective view of an ion removal means and a detergent injection case as used in FIG. 4.
Figure 6:
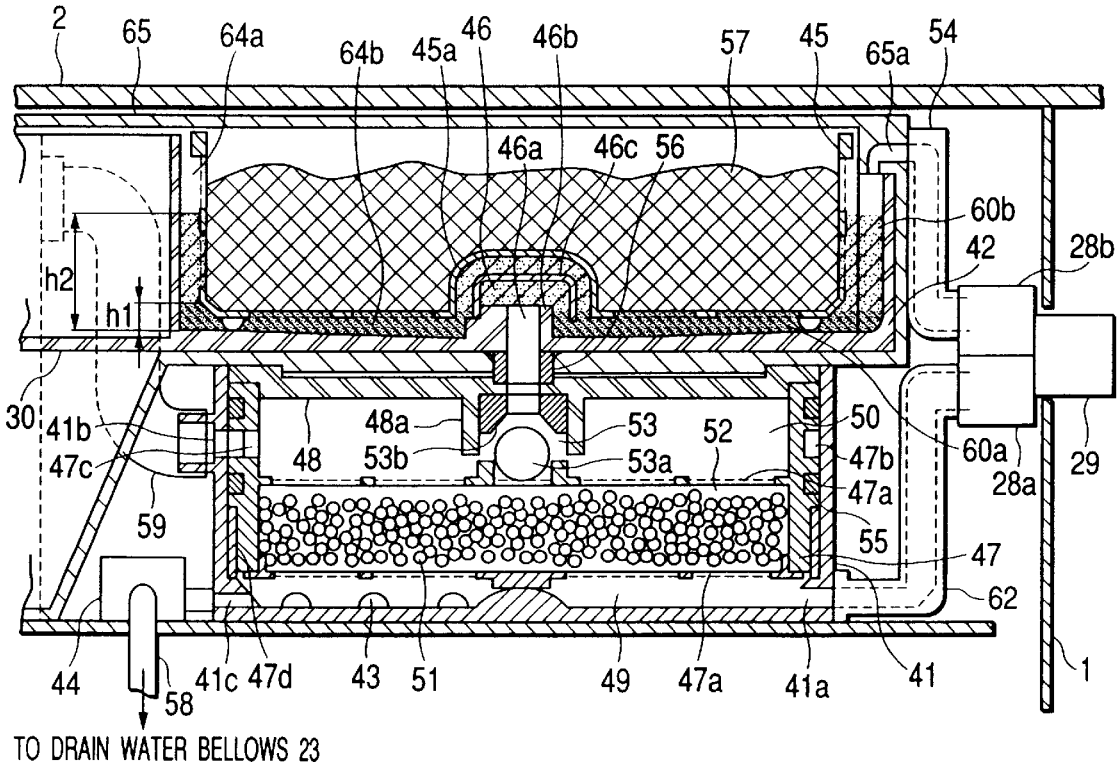
FIG. 6 is a longitudinal cross-sectional view of the ion removal means of FIG. 5.

FIG. 5 and FIG. 6 show a detailed construction of the ion removal means, which an essential element of the present invention. FIG. 5 is a perspective view showing the ion removal means 40 and the detergent supply case 30, and FIG. 6 is a longitudinal cross-sectional view of the ion removal means 40. The ion removal means 40 is constituted by a cylindrical vessel 41, a salt water vessel 42 provided above the cylindrical vessel 41, and a salt vessel 45 provided in the salt water vessel 42. The salt water vessel 42 is formed integrally with the detergent supply case 30. The detergent supply case 30, in a front side thereof, has a detergent compartment 30*a* and a fabric softener compartment 30*b*, and, at a rear side thereof, the salt water vessel 42 is provided. During supply of the detergent and the fabric softener, the detergent supply case 30 is pulled out halfway, and during the salt supply time, the detergent supply case 30 is pulled out fully.

In the cylindrical vessel 41, a resin case 47 is provided with a lower space 49 and an upper space 50, and this resin case 47 is fixed to the cylindrical vessel 41 using a screw thread 47*d* which is provided on an outer peripheral portion. The height of the lower space 49 is 3–5 mm to restrain the height of the ion removal means 40. To an outer peripheral portion of the resin case 47, a sealing member 55 is provided, which prevents water from flowing through a gap formed between the cylindrical vessel 41 and the resin case 47. Further, on an upper face of the resin case 47, an upper plate 48 is provided having a hole at a central portion thereof, and this upper plate 48 is fixed to the resin case 47 with an adhesive or by welding.

At a substantial center in a height direction and on a lower face of the resin case 47, upper and lower mesh filters 47*a* are provided, respectively, and between the upper and lower mesh filters 47*a*, a resin chamber 52 is formed. In the resin chamber 52, a sodium-type strong acid positive ion exchange resin 51 (hereinafter simply called an ion exchange resin) serving as an ion exchange resin material, is filled up. The mesh filter 47*a* prevents the ion exchange resin from flowing-out of the resin chamber 52 and prevents foreign matter from entering the resin chamber 52. The ion exchange resin 51 is in a commonly and generally used beads form, but it also may have a fiber form.

To a lower portion of the cylindrical vessel 41, a water entrance port 41*a* is provided, which opens into a lower space 49, and at a bottom portion of the lower space 49 a regeneration water drainage opening 41*c* is provided. The feed water pipe 62, which is connected to the feed water electromagnetic valve 28*a*, is connected to the water entrance port 41*a*. In the regeneration water drainage opening 41*c*, a regeneration water drainage valve 44 is installed, and the outlet of the regeneration water drainage valve 44 is connected to a drainage tube 58, the other end of the drainage tube 58 being connected to a lower portion 23*a* of a drainage bellows 23, as seen in FIG. 2.

The upper space 50 and a circular peripheral groove 47*b*, which is provided on an outer peripheral face of the resin case 47, are in communication with plural holes 47*c*, which are provided in the resin case 47. In the cylindrical vessel 41, a discharge port 41*b* is provided to communicate with the circular peripheral groove 47*b*. The discharge. port 41*b* and the detergent supply case 30 are connected to the feed water pipe 59.

In the upper space 50, a check valve 53 is provided. The check valve 53 is constituted of a ball 53*a* and a valve seat 53*b*. The ball 53*a* is made of, for example, polypropylene having a material of a density of less than 1 (g/cm$^3$). The reasons why the check valve 53 is provided is for use in a case where the city water pressure is low and the flow rate is very small (a flow speed of the water is slow). When there is water in the upper space 50, the ball 53*a* will float up and engage in close contact with the valve seat 53*b*, so that during the supply of water, the check valve 53 can prevent water from leaking into the upper portion. At times other than the feed water time, since water does not exist in the upper space 50, the ball 53*a* will fall by itself due to gravity, so that the passage 46*a* will be open. The valve seat 53*b* is mounted within annular projection 48*a* which is provided on a lower face of the upper plate 48. The valve seat 53*b* is made of a rubber material and a hole which is formed at a center portion thereof is in communication with the passage 46*a* of a siphon 46, to be described later. Further, the annular projection 48*b* operates to prevent the ball 53*a* from falling out of the check valve 53.

Above the cylindrical vessel 41, the back end of the water reservoir 65 is arranged, in the part of the water reservoir 65, the square shaped salt water vessel 42, which is provided integrally with the detergent supply case 30, is provided. To a connection portion between the water reservoir 65 and the cylindrical vessel 41, a sealing member 56 having a hole at the center thereof is provided. The central hole 46*a* of the siphon 46 is in communication with the upper space 50 of the cylindrical vessel 41 through the hole in the sealing member 56 and the check valve 53. The upper plate 48 of the salt water vessel 41 has an opening aligned with a central portion of a bottom face of the siphon 46. An inside bottom face, which is the lowest portion of the siphon portion 46, forms conic shape. This means that the water which enters the salt water vessel 42 will gather at the siphon 46. Actually, it is enough to have 2 mm degree height difference between an outer brim portion of the bottom face of the salt water vessel 42 and the siphon portion 46.

To a rear face of the water reservoir 65, a feed water conduit 54 is provided from the salt / feed water electromagnetic valve 28*b* is provided. The feed water conduit 54 is connected to a passage 65*a* of the water reservoir 65, and this passage 65*a* opens into the salt water vessel 42.

Figure 7:
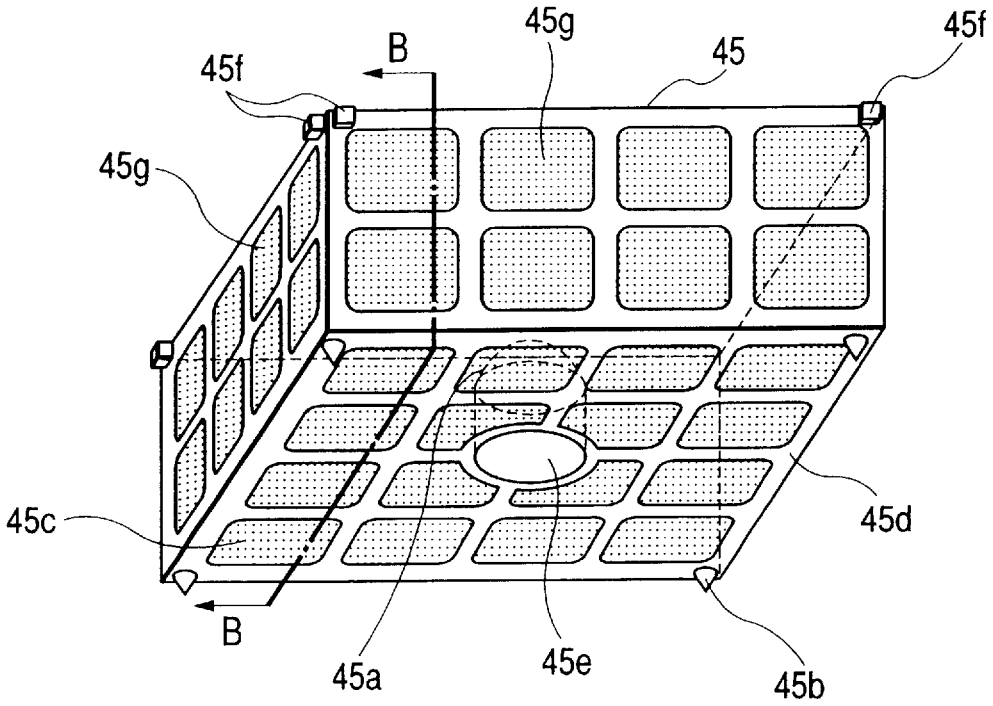
FIG. 7 is a perspective view of a salt vessel of the ion removal means of FIG. 6.
Figure 8:
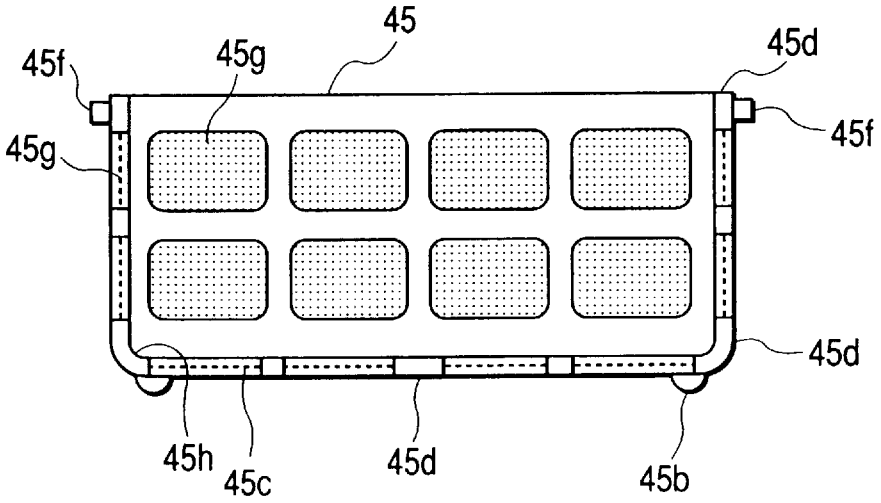
FIG. 8 is a longitudinal cross-sectional view taken along line B—B in FIG. 6.

In the salt water vessel 42, an attachable and detachable square shaped salt vessel 45 is arranged. FIG. 7 and FIG. 8 show the details of the salt vessel 45. FIG. 7 is a perspective view of the salt vessel 45 as seen from a lower portion. FIG. 8 is a longitudinal cross-sectional view taken along line B—B of FIG. 7. The salt vessel 45 is formed with a frame 45*d,* and the upper face thereof is open. Mounted on the frame 45*d,* at a bottom portion, a mesh filter 45*c* is provided and at a side face, a mesh filter 45*g* is provided. At the four corners on the bottom of the frame 45*d* small feet 45*b* are provided, and on the outside of the frame at an upper portion, side projections 45*f* are provided. The feet 45*b* and the side projections 45*f* serve to position the salt vessel 45 relative to the salt water vessel 42. The side projections 45*f* also may be arranged at the lower portion of the frame.

Between the salt vessel 45 and the salt water vessel 42 there is a gap 64*a,* and there is a gap 64*b* between the bottom of the salt vessel 45 and the salt water vessel 42. It is preferable for the gap 64*a* to be 2–5 mm, and it is preferable for the gap 64*b* to be 3–4 mm. The reasons for this will be stated later. At a central portion of a bottom of the salt vessel 45, a cylindrical-shaped projection 45*a* having a space 45*e* is provided. The projection 45*a* is provided to prevent interference with the siphon 46 of the salt water vessel 42.

In the salt vessel 45, salt 57 is provided in advance by the operator. The supply of the salt 57 is carried out from the front face of the washing machine by pulling out the detergent supply case 30. Further, the salt vessel 45 can be removed from the salt water vessel 42, so that the supply of the salt 57 is carried out at a place where the operator can work easily, thereby relieving any concern about the possibility of scattering the .salt 57. Also, a cleaning of the salt vessel 42 can be carried out easily. Further, although not shown in drawing, the salt vessel 45 is formed with a handle or has an easy carrying shape which the operator can handle easily. As to the salt to be used, a low cost of manufacture salt is most suited because of the small amount of impurities (generally a mineral component of calcium and magnesium). The mesh filters 45*c* and 45*g* of the salt vessel 45 prevent the flow-out of the salt particles and further prevent the dropping off of the dried salt to the outside during the time that salt is supplied to the salt vessel 45. Accordingly, as to the sizes of the mesh of the mesh filters 45*c* and 45*g,* since the particle diameter of the manufactured salt is about 0.2 mm–0.8 mm, it is preferable to have the size of the mesh be 0.1 mm–0.15 mm.

The amount of the salt carried by the salt vessel 45 is that which is necessary to carry out plural regenerations. In this embodiment according to the present invention, the amount is about 500 grams. This amount corresponds to twenty times the salt amount of 25 g which is necessary for one regeneration processing of the resin exchange resin 51. Thus, when washing is carried out one time per one day, the operator will need to replenish the supply of salt 57 once in about a half-month. The volume of the salt vessel 45 is 500 mL—500 mL to receive 500 grams of the dried salt. In the embodiment according to the present invention, the salt vessel 45 has a width of 125 mm, a length of 80 mm, and a height of 55 mm (volume 550 mL), and the salt water vessel 42 has a width of 135 mm, a length of 90 mm and a height of 60 mm.

The hose from the city water supply is connected to the city water faucet port 29. By opening and closing the feed water electromagnetic valve 28, the city water is passed through the feed water pipe 62 to the water entrance port 41*a* of the cylindrical vessel 41; and, the water fills up the lower space 49 and rises up through the resin chamber 52, in which the ion exchange resin 52 is provided. At this time, the check valve 53 plugs the hole 46*a* as the ball 53*a* floats up with the rising water.

The city water is subjected to softening in the resin chamber 52, in other words, calcium ions and magnesium ions are removed. Then, as the water rises into the upper space 50, it passes through the hole 47*c* the resin case 47 and through the circular peripheral groove 47*b* so as to flow through the discharge port 41*b.* After that the water passes through the feed water pipe 59 and enters into the water reservoir 65, it dissolves the detergent which has been provided in advance in the detergent supply case 30, flows down the water pipe 39 and is supplied to the outer tub 3 (the drum 7).

In this embodiment according to the present invention, the particle size of the ion exchange resin 51 is 0.2 mm and the resin amount is 150 mL. The amount of water used during the washing time of the drum type washing machine is 15–30 L. Thus, by using an ion exchange resin having the above-stated particle size in the above-stated amount, when the feed water amount is 30 L, water having a hardness of 300 ppm (calcium carbonate conversion) can be softened to have a hardness of 40 ppm.

The inner diameter d of the resin case 47 is 95 mm, and the thickness L of the ion exchange resin layer is about 21 mm. As stated above, since the ion exchange resin layer is formed as a flat layer, the flow passage area of the ion exchange resin layer becomes large, and the flow speed becomes small; accordingly, the pressure loss at the ion exchange resin layer can be made small. Accordingly, drop in the feed water flow rate by the provision of the ion removal means 40, in which the ion exchange resin is provided, can be restrained to a minimum value. For example, in a case where the city water pressure is very low, such as 0.029 Mpa, when there is no ion removal means 40, the feed water amount is 6.3 L per minute, but when the above-stated ion removal means is provided, the feed water amount is 5.5 L per minute, so that the drop in pressure can be limited to a value of about 13%. Further, in a case where the city water pressure is 0.29 Mpa, the feed water amount of 15.5 L per minute is reduced to a feed water amount is 14.6 L, so that the drop can be limited to a value of about 6%. Further, the ion exchange resin layer is formed so as to be flat, so that the height becomes low, accordingly, sufficient space for receiving 500 grams of salt in the salt vessel 45 can be secured.

Figure 9:
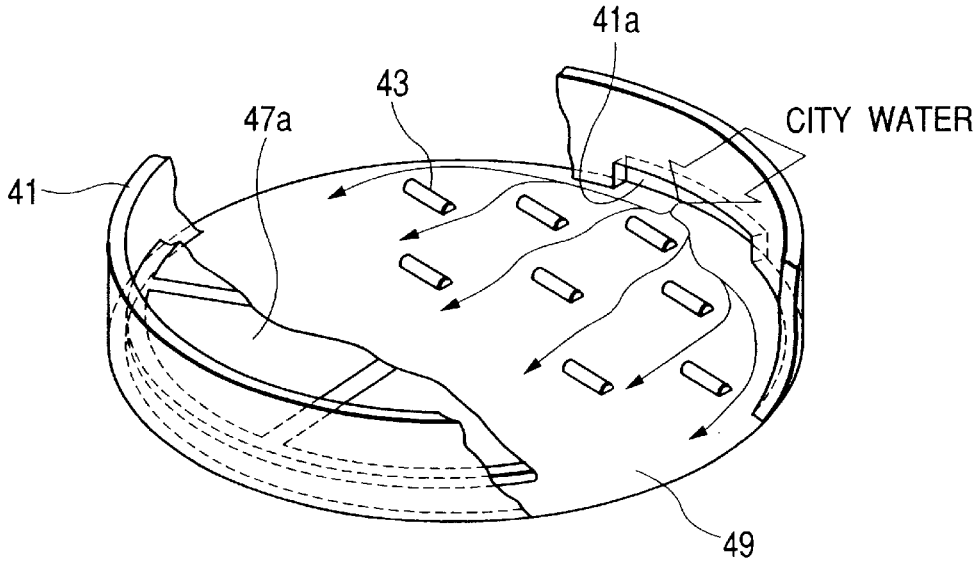
FIG. 9 is a perspective view of a lower portion space of a resin case in FIG. 6.

In this embodiment according to the present invention, to restrain the height of the ion removal means to the utmost, the above-stated ion exchange resin layer is formed so as to be flat, and the height of the lower space 49 is set to 3–5 mm. For this reason, the water from the slit-shaped water entrance port 41*a* forms a jet flow as it flows into the lower space 49. Accordingly, the flow of the water in the ion exchange resin layer becomes non-uniform, so that water flows and only to one part of the ion exchange resin layer. Thus, there is a possibility that this will cause a drop of the hardness removal ability. Accordingly, as shown in FIG. 9, in the lower portion space 49, rectification members or baffles 43 are provided. The rectification member 43 after the jet shaped flow of the water so that the water is caused to flow into the whole ion exchange resin layer uniformly, whereby the metal ion can be adsorbed effectively.

The ion exchange resin 51 is a synthetic resin in which bridged three-dimensional high polymer base substance is combined with the ion exchange substance, such as a surfonic group substance, according to chemical combination. When the city water which contains divalent positive ions (the hardness compound), such as calcium ions and magnesium ions etc., flows into the positive ion exchange resin, the surfonic group, which is the ion exchange base substance of the positive ion exchange resin, and the positive ion in the city water carry out an ion exchange, and the positive ions in the city water are removed.

The chemical formula 1 and the chemical formula 2 represents the ion exchange reaction formula of the sodium type strong acid type positive ion exchange resin.

$$R(SO_3Na)_2+CaCI_2\ R(SO_3)_2Ca+2NaCI \text{(formula 1)}$$

$$R(SO_3Na)_2+MgCI_2\ R(SO_3)_2Mg+2NaCI \text{(formula 2)}$$

The sodium type positive ion exchange resin is an ion exchange resin in which —$SO_3$ as the negative ion is the static ion and Na (sodium) as the positive ion is the counter ion, and by utilizing the selection property, the polyvalent positive ions, such as the calcium ions and the magnesium ions etc., which are contained in the water, are removed. The calcium ions and the magnesium ions in the water which pass through the ion exchange resin carry out an ion exchange with all sodium ions in the ion exchange resin in accordance with the reaction from the left side to the right side of the chemical formula 1 and the chemical formula 2. When all sodium ions in the ion exchange resin have been subjected to ion exchange with the calcium ions and the magnesium ions, the ion exchange resin losses its ion removal ability. Accordingly, to repeatedly use the ion exchange resin. it is necessary to regenerate the ion exchange resin to recover its ion removal ability. In the case where a sodium type positive ion exchange resin is used, to regenerate the ion exchange resin, salt water is used. When salt water is caused to flow into the ion exchange resin in which magnesium ions have been adsorbed, in accordance with the reaction from the left side to the right side of the chemical formula 1 and the chemical formula 2, the calcium ions and the magnesium ions are subjected to ion exchange and are separated from the sodium ions and return to the resin; accordingly, the ion exchange resin can be regenerated in this way. It is known that the highest regeneration efficiency can be achieved by using salt water with about 10% concentration salt for the regeneration.

A conventional compact type water softener, which was used in an experiment, in generally has an ion exchange resin amount of 1–2 L and a processing flow rate of 10 L per hour (0.16 L per minute). As stated above, in a domestic washing machine, the water is supplied directly from the city water faucet to the washing tub. The feed water amount is 6–20 L per minute according to the city water pressure. Accordingly, in the above-stated compact size water softener, since the feed water time is prolonged, it is necessary to utilize the batch processing matter using the time except for the washing after it is accumulated in the accumulation tub once. Further, the ion exchange amount of 1–2 L is an excessive volume to mount (installed in inner portion) in a domestic washing machine. In other words, in a domestic washing machine, it is necessary to solve the problems the processing flow rate and the resin amount of the above-stated ion exchange resin.

Figure 10:
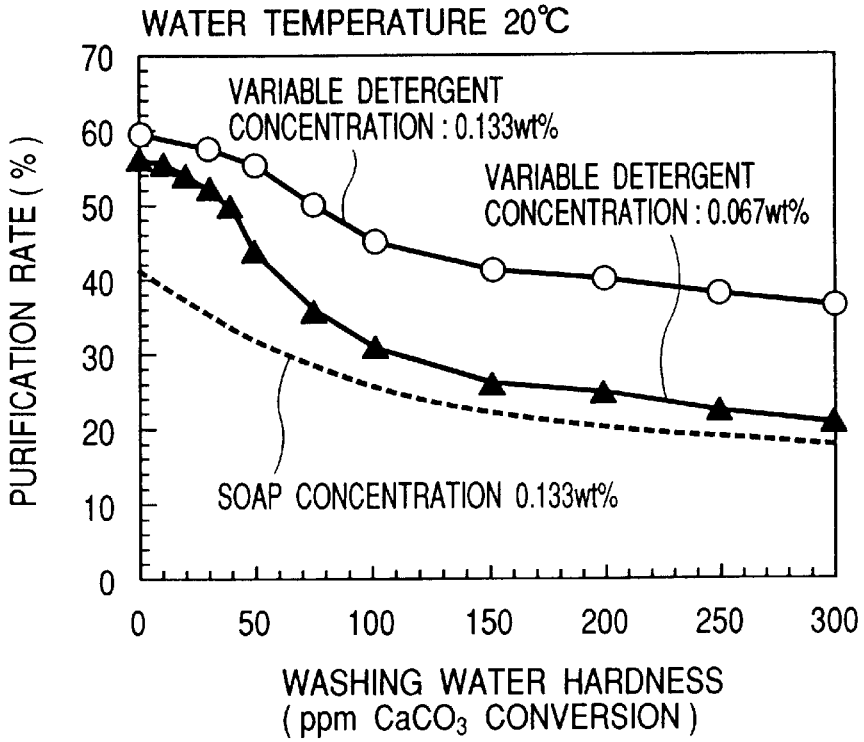
FIG. 10 is a graph showing a relationship between the hardness and the detergency.

FIG. 10 shows a relationship between the cleaning rate and the hardness in a case where a conventional synthetic detergent containing a compact type zeolite is used. In this figure, a case where the detergent concentration is 0.067 wt %, which is the maker's designation amount, and a case where the detergent concentration is 0.133 wt %, which is two times the above case, as shown. The cleaning rate in the figure is defined according to the following numerical formula 1.

$$D=(Rw-R1/R0-R1)\times 100\ (\%) \text{ (numerical formula 1)}$$

In the numerical formula 1, D indicates the cleaning rate, R1 is an artificial contamination clothes reflection rate, Rw indicates an artificial contamination clothes reflection rate after the washing, and R0 is an original reflection rate of the clothes.

The artificial contamination of the clothes and the experimental method were regulated according to Japan Industrial Standard (the electric washing machine, JIS C 9609-1993).

As clearly shown in FIG. 10, the higher the hardness is, the more the cleaning rate lowers. Naturally, when the detergent amount increases, the cleaning rate improves. Under a high hardness in which the hardness is 100–300 ppm, since two times the designated detergent amount specified by the detergent maker is used (the detergent concentration of 0.133 wt %), a cleaning rate similar to water having a hardness of 500 ppm and a detergent concentration of 0.067 wt % can be obtained. However, increasing the detergent amount increases is not preferable because of the bad affects on rinsing (using the same rinsing water amount, since the residue detergent concentration after the rinsing is high, to carry out the rinsing, it is necessary to use a large amount of water), in addition to the effects on the environment.

With a detergent concentration of 0.067 wt %, when the hardness becomes less than 40 ppm, the cleaning rate becomes substantially constant. With a hardness of less than 40 ppm, the zeolite which is contained in the synthetic detergent adsorbs almost all of the hardness component, since the amount of the surfactant is sufficient, and the cleaning rate becomes substantially constant. With a hardness 40 ppm, the zeolite amount becomes insufficient and a part of the surfactant reacts with the hardness component, so that a metallic soap is produced. Since the amount of the surfactant is reduced, the detergent rate lowers. Accordingly, when a synthetic detergent containing zeolite is used for the washing, it is desirable to remove the calcium ions and the magnesium ions of the hardness component from the washing water to produce a hardness under 40 ppm. For example, when water having a hardness of 300 ppm is softened to have a hardness of 40 ppm, the cleaning rate improves more than two times, even when the detergent amount is not increased, and the cleaning rate can be increased. On the other hand, in general, zeolite is not contained in soap, as shown by the broken line of FIG. 10, since the cleaning rate lowers with an increase in the hardness, it is preferable to remove the hardness component to the utmost.

As stated above, when the calcium ions and the magnesium ions forming the hardness component are removed, the detergency of the washing machine can be improved remarkably. Further, when a cleaning rate similar to that of the city water is used leaving it is permitted, by obtaining soft water, the detergent use amount can be reduced. Further, in the area of the hardness of more than 40 ppm, it is unnecessary to use more than a necessity amount of detergent, and so the affect on the environment can be lessened.

Figure 11:
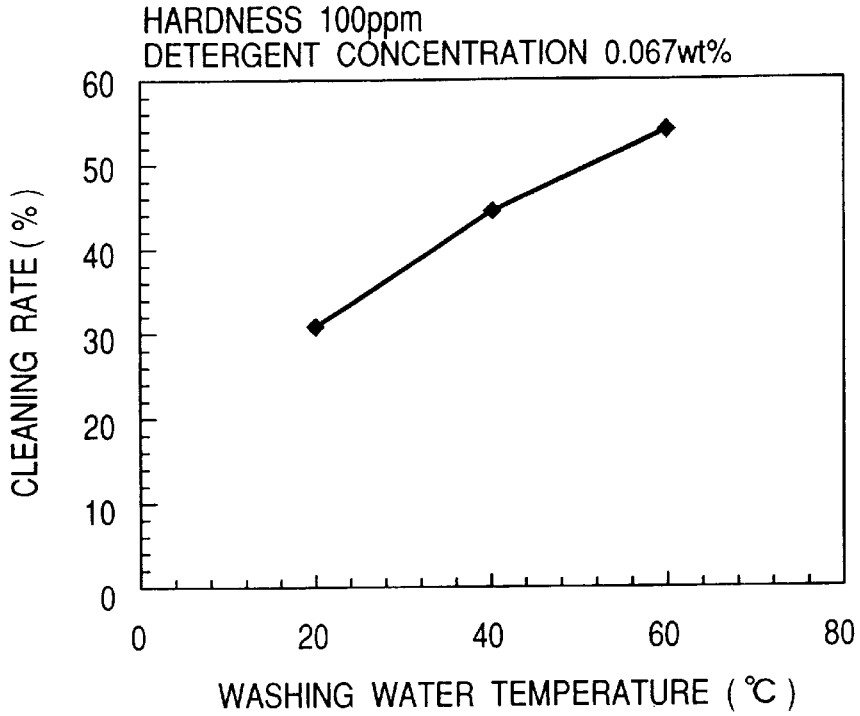
FIG. 11 is a graph showing a relationship between the washing water temperature and the detergency.

On the other hand, the relationship between the water temperature and the cleaning rate is shown in FIG. 11. The detergent used here is one similar to that of FIG. 10 and the hardness of the water is 100 ppm. The higher the water temperature is, the more the cleaning rate improves. The reason for this is that the higher the water temperature is, the higher will be the activity of the detergent and the ease of dissolution of the detergent, so that dirt, in particular, fat, such as skin fat, is fluidized and comes off easily. The average water temperature of the city water is about 20° C., and when the water temperature is 60° C., the cleaning rate increases by about two times.

From FIG. 10 and FIG. 11, when the hardness is less than 40 ppm, with the city water having a temperature of 20° C., it will be understood that cleaning rate similar to the case of hot water having a temperature of 60° C. can be obtained. In Europe, the common drum type washing machine has a technique to compensate for a drop in the cleaning rate according to the above-stated hardness component, in which an electric type heater is installed and the washing water temperature is raised, so that washing is carried out by use of hot water.

The ion exchange performance of the ion exchange resin is determined by the ion exchange capacity (the capacity for gathering (the ion exchange) of the positive ions in the ion exchange resin), the ion exchange speed and the like. In a washing machine, when an ion exchange rein is used, it is required that the processing flow rate is 6–20 L per minute, and the resin amount is as small as can be accommodated by the washing machine. For these requirements, it is preferable that the ion exchange speed is made large to the utmost and the ion exchange capacity is made large and the resin amount is reduced. The ion exchange capacity and the ion exchange speed vary according to the bridge property of the ion exchange resin and the structure (gel type, multiporous property) of the resin, the resin diameter and the like. However, when the bridge property rises, the ion exchange capacity increases, but the ion exchange speed drops, when a multiporous property is employed, in comparison with the gel type, and the ion exchange speed rises, however, the ion exchange capacity decreases. As stated above, it is difficult to improve both performances of the bridge property of the ion exchange resin and the structure of the resin at the same time.

Figure 12:
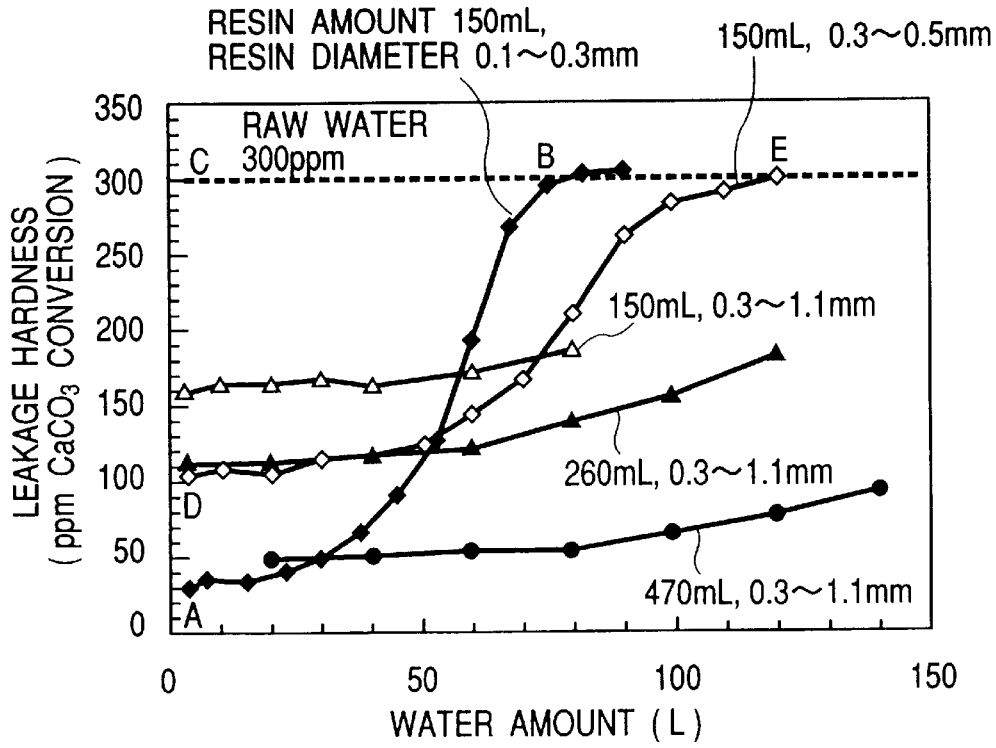
FIG. 12 is a graph showing a relationship between the feed water amount, the leakage hardness, and the ion exchange resin amount, and the resin diameter.

FIG. 12 shows results in which, with respect to the most generally used sodium type positive ion exchange resin, having a bridge property of 8% to obtain soft water from hard water, the changes of the leakage hardness relative to the feed water amount was investigated by experiment with the parameters of the ion exchange resin amount and the resin diameter. The total hardness of the raw water is 300 ppm, and the flow rate is 15 L per minute. As to the experimented resin amount and the experimented resin diameter, in any case, the hardness component leaks and the concentration differs according to the resin amount and the resin diameter. The leakage hardness at the feed water initial stage, in the same resin diameter, is small when the resin amount is large, but with the same resin amount, when the resin diameter is small the leakage hardness is small.

Figure 13:
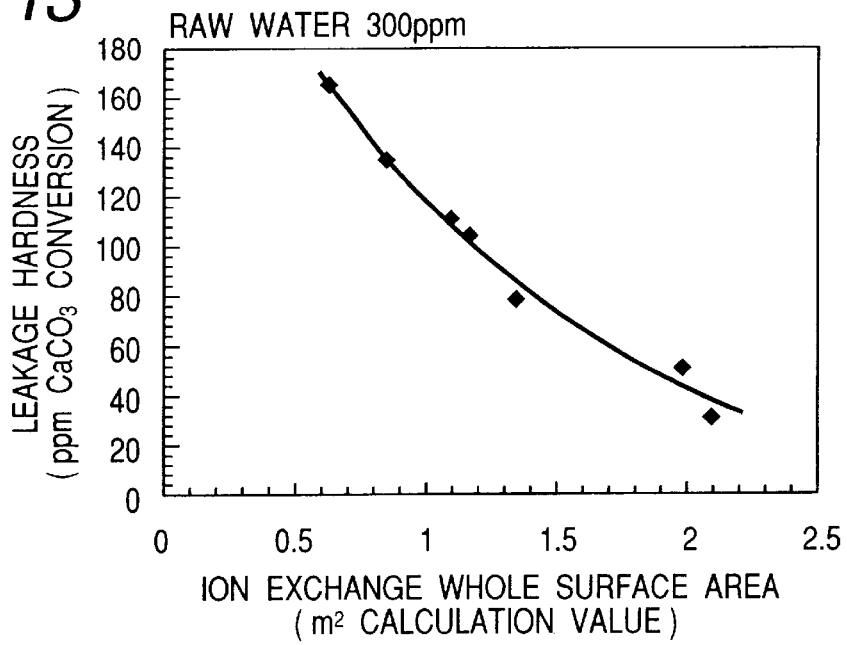
FIG. 13 is a graph showing a relationship between the ion exchange resin surface area and the leakage hardness.

FIG. 13 shows the results in which the leakage hardness of the feed water initial stage shown in FIG. 12 is rearranged and amended relative to the hole surface area (the calculation value) of the ion exchange resin. As seen in this figure, the leakage hardness is in inverse proportion substantially to the whole surface area of the ion exchange resin, but the ion exchange speed is in proportion substantially to the whole surface area of the ion exchange resin. Since the whole surface of the ion exchange resin is in proportion to the ion exchange resin amount, but is in inverse proportion to the ion exchange resin diameter, by forming the resin diameter small, the resin amount can be made small.

As understood by FIG. 12, the change of the leakage hardness is substantially constant at the feed water initial stage, but when the feed water amount increases from some point, it increases abruptly, and at last it losses its ion exchange ability and has the same hardness as that of raw water. The ion exchange capacity is expressed by an area which is enclosed by the leakage hardness line and the raw water hardness line (the broken line), and regardless of the resin diameter, it is in proportion to the resin amount. For example, in an enclosed area ABCA in FIG. 12, in the case of a resin amount of 150 mL and a resin diameter of 1–0.3 mm, equals an enclosed area DECD, in the case of the resin amount of 150 mL with a resin diameter of 0.3–0.5 mm.

The ion exchange capacity of the ion exchange resin shown in FIG. 12 is 2.0 meq/mL-R (2.0 equivalents per the ion exchange resin 1 mL), and by $CaCO_3$ conversion per 1 mL of the resin, the hardness component of 100 mg can be removed. Herein, it will be considered that the city water having a total hardness of 300 ppm flows with a flow rate of 15 L per minute and the water amount used during the washing time in the drum type washing machine is subjected to softening. The soft water formation reduces the hardness to 40 ppm, which produces no affect on the detergency of the synthetic detergent containing the zeolite, so that the hardness component to be removed is 7.8 grams ($CaCO_3$ conversion); and, when only the ion exchange amount is considered, the necessary minimum resin amount is a small amount, such as 78 mL. However, when taking into consideration the ion exchange speed, with this resin amount, it is impossible to obtain the formation of soft water. Actually, as shown in FIG. 12, in the case of a minimum resin diameter of 0.1–0.3 mm, it is necessary to have a resin amount of 150 mL. When the resin diameter is larger than the above-stated case, it is impossible to make the resin amount to 470 mL, but it is not make less than of 40 ppm.

From the above, in a drum type washing machine, when ion exchange resin having a resin diameter of 0.1–0.3 mm is used, even if the resin amount is small, such as 150 mL, it is possible to realize ion removal means in which the ion removal (the formation of the soft water) from the washing water for at least one washing, and to compactly mount the ion removal means in the domestic drum type washing machine. Further, when the resin diameter is smaller, it is possible to reduce further the resin amount, but the pressure loss in the ion exchange resin increases and the feed water amount drops. Thus, when taking into consideration the possibility of the clogging of the resin exchange, it is preferable to use a resin diameter of more than 0.1 mm.

Herein, the method of measuring the ion exchange resin amount will be explained. In general, the amount of the exchange resin is expressed using the volume. As to the volume measuring method, there are a method using a monopoly volume measuring means and a method using a scalpel cylinder. Since the former method is complicated, in this embodiment according to the present invention, the resin amount was measured according to the latter scalpel cylinder method. In the scalpel cylinder method, the scalpel cylinder in which the water is poured in advance, the ion resin exchange resin is inserted, and by patting the bottom portion of the scalpel cylinder, the volume hardly reduced more is read and then the measurement is carried out. Further, in the production process when the resin is filled up to the apparatus, since the volume being measured one by one using the scalpel cylinder is inefficient, by measuring the relationship between the resin volume which has been measured by the above-stated method and the cutwater resin mass, since the resin amount is treated by the mass, this method is efficient.

Figure 14:
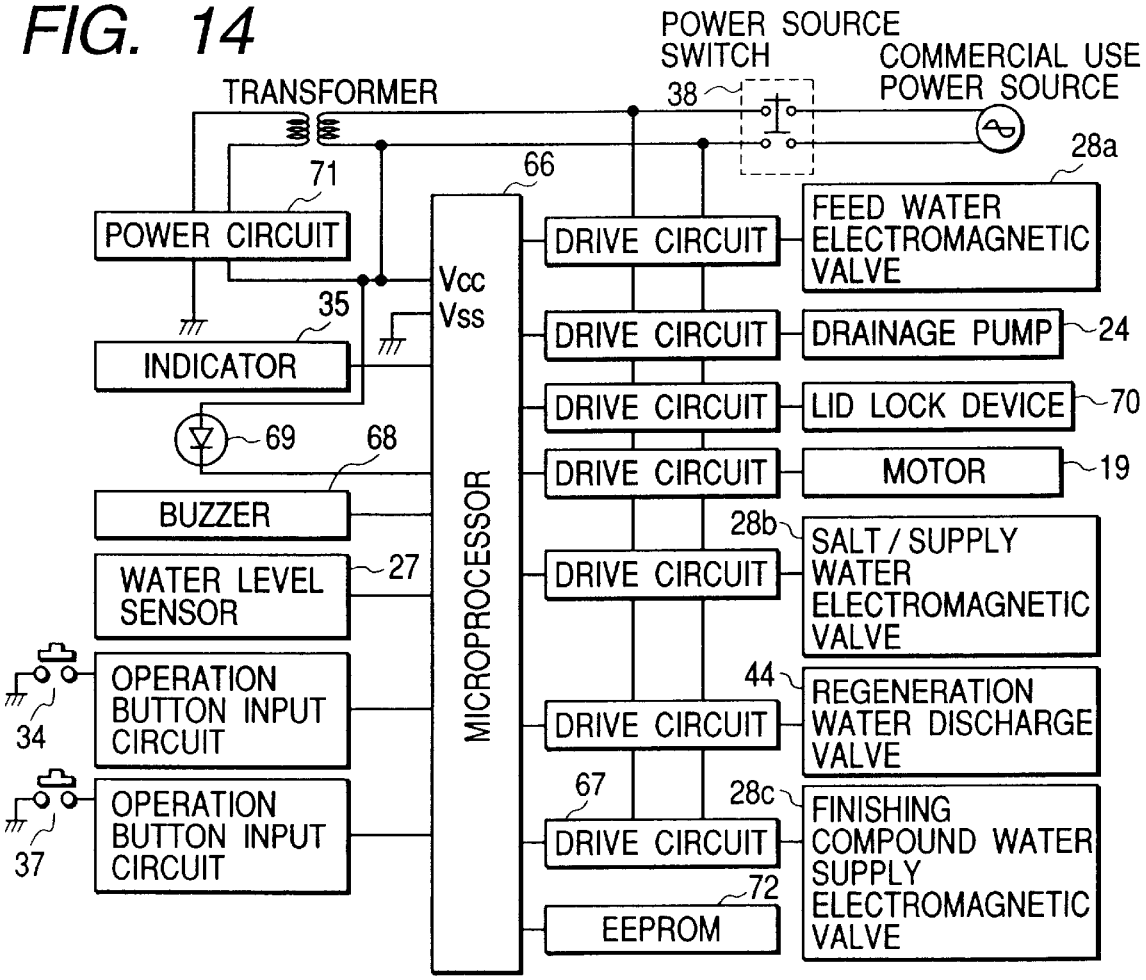
FIG. 14 is a block diagram of the controller of the drum type washing machine of FIG. 1.

FIG. 14 is a block diagram of the washing machine control unit in which a microprocessor 66 is constituted as a main component. The microprocessor 66 is connected to an operation button input circuit 34 and a water level sensor 27 and receives information signals about the button operation by the operator and the water level of the water in the washing machine. An output of the microprocessor 66 is connected to a drive circuit 67 which is constituted by a bidirectional three terminal thyristor, which supplies commercial power to the above stated motor 19, the feed water electromagnetic valve 28*a,* the salt / feed water electromagnetic valve 28*b,* and the drainage pump 24 and the like, and it controls the opening and closing or the rotation of these elements. Further, to provide notice of the operation of the washing machine to the operator, the microprocessor 66 is connected further to a buzzer 68 and an indication means 35 and the like. A power source 71 rectifies and smoothes the commercial power and forms a direct current source necessary for the microprocessor 66. A reference numeral 69 indicates a luminescence diode for indicating the need to supply salt by the turning-on. The luminescence diode 69 is mounted on the operation panel 31 and turns on the at a time when it is necessary supplement the salt in the salt vessel 45 and gives notice to the operator according to the salt supplement indication means. A salt supplement completion button 37 is a button which is pushed by the operator upon completion of the salt supplement and is mounted on the operation panel 31. By pushing the salt supplement completion button 37, the microprocessor 66 turns off the luminescence diode 69 and turns off the salt supplement indication means.

Next, the operation of the drum type washing machine according to the present invention will be explained. FIG. 15 shows an outline operation flow chart.

The operator pushes the power source switch 38 (a step 101). At this time, if the salt has not been supplied to in the salt vessel 45, the salt supplement indication means 35 is lighted (a step 102). In this case, the operator draws out the detergent supply case 30 and inserts about 500 grams of salt in the salt vessel 45 (a step 123). When the supplying of the salt is completed, the operator pushes the salt supplement completion button 37 (a step 124). The microprocessor 66, which has detected the actuation of the salt supplement completion button 37, turns off the luminance diode 69 and the salt supplement indication means 35 is turned off (a step 125).

Next, when the operator pushes the door opening button 34*c,* the microprocessor 66 operates to release the lid lock 70. The operator opens the lid 17 and inserts items to be washed through the port 9*a* and into the washing machine and closes the lid 17. Further, the operator supplies the detergent and the finish softener, if necessary, to the detergent supply case 30. After the operator has selected the washing course according to a course selection button 34*b,* the operator operates the start button 34*a* (a step 103). The microprocessor 66 operates to open the feed water electromagnetic valve 28*a* (a step 104).

The water which has passed through the feed water electromagnetic valve 28*a* from the city water faucet 29, as stated above, passes through the ion removal means 40 and flows into the water reservoir 65. The water which has entered in the water reservoir 65, is shaped on the upper portion of the detergent which is present in the detergent supply case 30 in advance and the water dissolves the detergent and flows down the water case 39 and accumulates in the outer tub 3.

Figure 16:
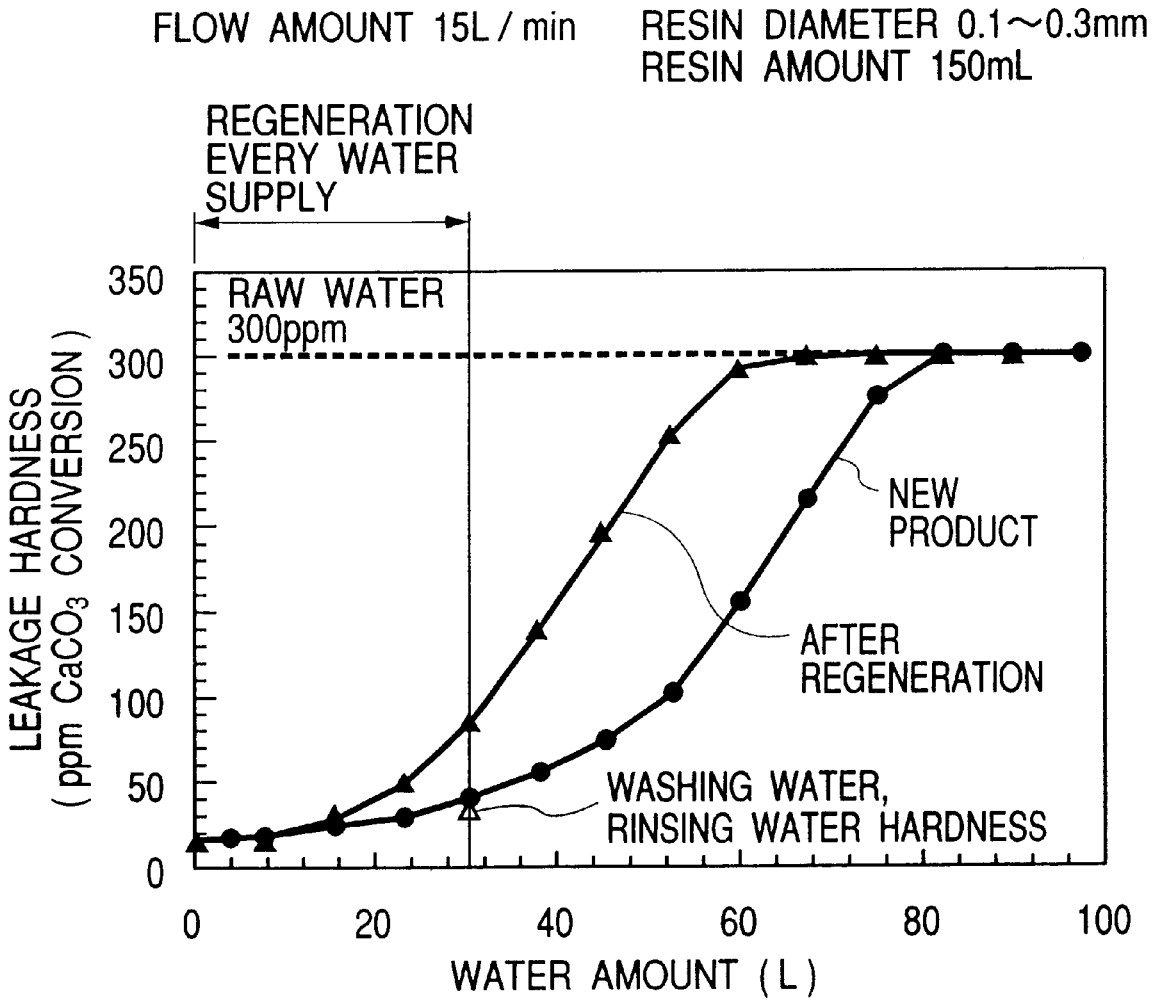
FIG. 16 is a graph showing a relationship between the water amount bed to the ion removal means and the leakage hardness.

As to the city water, as it passes through the ion exchange resin 51, according to the ion exchange action of the ion exchange resin 51, the calcium ions and the magnesium ions contained on the city water are removed. FIG. 16 shows a relationship between the leakage hardness and the feed water amount at the discharge port 4 in a case of the resin diameter of the ion exchange resin 51 being 0.1–0.3 mm and the resin amount of the ion exchange resin being 150 mL, with the water having a total hardness of 300 ppm flowing under a flow rate of 15 L per minute. In this figure, ▲ mark shows a case in which the ion exchange resin is new and ● mark shows a case after the ion exchange resin is regenerated using salt water having concentration of 10% and an amount of 300 mL. As understood from the figure, after the regeneration comparing with the new product, there is much leakage hardness. This shows that all of the ion exchange base substances are not regenerated. When the amount of the salt water for the regeneration increases, it can approach the new product, however when water having a hardness of 300 ppm and an amount of 30 L is softened to a hardness of 40 ppm, it will be enough. The following explanation will be made with reference to the leakage hardness (▲ mark) after the regeneration.

Initially time the leakage hardness is constant and is about 18 ppm, the feed water amount starts to increase from a little less than 10 L, and at the feed water amount of 30 L, the leakage hardness becomes about 88 ppm. Accordingly, at the next feed water time, to obtain water having a hardness of less than 40 ppm, it is necessary to carry out a regeneration.

The lowering of the hardness in the feed water initial stage has the following merits. At the first time of use of the feed water, the water is supplied by dissolving the detergent which is held in the detergent supply case 30. At this time, when the hardness is low, since it hardly combines the surfactant of the detergent with the hardness component, the detergent does not form a metallic soap, but is dissolved easily. And, since the washing water in which the detergent has been dissolved soaks into the items to be washed and acts on the dirt, the removal of stains can be improved. With the increase of the feed water amount, the leakage hardness rises, however the detergent in the detergent supply case is gone already, so that there is no way in which the detergent can produce metallic soap in the detergent supply case 30. In FIG. 16, the matters shown in ● mark represent the hardness of the washing water which is accumulated in the outer tub 3. The hardness of the washing water is shown by the average of the ▲ mark leakage hardness, and with a feed water amount of 30 L, it becomes about 38 ppm, which is less than 40 ppm.

Further, when the feed water and the washing are controlled as shown in the following, the detergency can be improved further. The feed water is stopped once at a midway and by rotating normally and reversibly the drum 7, the washing water is soaked into the items to be washed and then the washing is started. After that, the feed water amount is increased, and finally water in a regular amount (in this embodiment, it is 30 L) is supplied.

For example, when the feed water is stopped at the amount of 10 L, the hardness of the washing water which is accumulated in the outer tub 3 becomes about 20 ppm. At this time, the inflow of almost all of the detergent, which is contained in the detergent supply case 30, to the outer tub 3, is completed. Since the amount of the detergent is the amount which is suited to the water amount of 30 L, for the feed water amount of 10 L, the detergent concentration of the washing water in the outer tub 3 becomes three times. Accordingly, the hardness is low,. and further, by using washing water having a high detergent concentration, the washing can be carried out. When the detergent concentration is high, the surfactant is immersed effectively into the dirt and since the dirt is removed easily from the items being washed, the detergency can be improved. Since the water amount is low, there is a concern of damage, in the drum type washing machine, by a striking action by the fallen-down of the washing matter is a main mechanical action, and then there is no concern about an increase in the damage.

After that, the feed water is started again. Herein, the water hardness of the water being supplied becomes 30–80 ppm, the hardness becomes higher than the hardness of the 10 L of water supplied at first, since the dirt is floated up from the items during the washing in the high concentration detergent, the dirt disperses in the water added here and then the dirt is taken away from the items being washed.

The ion exchange resin 51 is oxidized by the residual chlorine of sodium hypochlorite which is in the city water to carry out antisepsis and the resin swells (the particle diameter of the ion resin becomes large). Accordingly, it is necessary to afford sufficient volume in the resin chamber 52 against the amount of the ion resin exchange 51 of the new product. The residual chlorine concentration of ordinary city water is substantially less than 1 ppm. When water having this concentration is supplied for a period of seven years (two times washing per day) which is the durable years of the washing machine, the swelling of the ion exchange resin 51 is about 5%. Accordingly, taking into the consideration the swelling of the ion exchange resin, it is necessary to make the volume of the resin chamber 52 larger by more than 5% relative to the ion exchange resin amount. In practical use, it is preferable to set the volume of the resin chamber 52 in a range of 5–10%. The reason why is that, if the resin chamber 52 is large excessively, in the resin chamber 52, an excessive deviation is generated in the ion exchange resin 51. At this time, the thickness of the ion exchange resin layer becomes non-uniform and an extremely thin part is formed, so that the water will not flow uniformly to the whole ion exchange resin and, accordingly, the ion exchange performance becomes low.

As stated above, the volume of the resin chamber 52 is larger than the ion exchange resin amount (there is a space in the resin chamber 52). This has following effects. The city water flows in the ion exchange resin layer toward the upper from the lower. Accordingly, during the feed of water, the ion exchange resin 51 moves to an upper side of the resin chamber 52 by the force of the water. When the feed water is stopped the ion exchange resin 51 is falls down to a lower side of the resin chamber 52. As stated above, when there is a space in the resin chamber 52, during the feed water start and the feed water stop, the ion exchange resin 51 is stirred in the resin chamber 52. In the city water, there is a case of the existence of the small dust (almost part of the iron rusts in the piping) which pass through the mesh filter 47*a*. When this dust remains in the ion exchange resin layer, clogging occurs. However, since the ion exchange resin is stirred, the dust is discharged to the outside of the resin chamber 52, and the occurrence of clogging can be prevented.

Immediately after of the salt supplement (a step 105), a water containing process for supplying the water to the salt is carried out. The microprocessor 66 operates to open the salt / feed water electromagnetic valve 28*b* (a step 126) and the water in the amount of 120–130 mL flows into the salt water vessel 42. The control of the water amount is carried out by controlling the opening time of the salt / feed water electromagnetic valve 28*b* taking into the consideration the city water pressure. The relationship between the city water pressure and the feed water flow rate (in actually, the time for accumulating from a water level 1 to a water level 2) is stored in a memory of the microprocessor 66 in advance. During the washing feed water time, a time T is measured, the city water pressure is determined by the above-stated relationship, and in response to the city water pressure, by controlling the opening time of the salt / feed water electromagnetic valve 28*b,* the water amount can be adjusted. The water is accumulated in the salt water vessel 42 and at the same time the water is absorbed in the dried salt 42 through the mesh filters 45*c* and 45*g*. All of the water of 120–130 mL are absorbed to the salt of 500 grams. The water which exists in a gap 46*b* part lower than the mesh filter 45*c* is absorbed to the salt by the surface tension. The time for absorbing all of the water to the salt is within one minute. With the above, the water supplying operation to the salt is finished.

During this water supplying process, the regeneration use salt water generation stated in a latter portion is carried out to obtain salt water having a stable mass concentration.

The microprocessor 66, when it has noticed that water in the regular amount has been supplied according to the water level sensor 27, operates to stop the feed water by closing the feed water electromagnetic valve 28*b*. Rotating normally and reversibly the drum 7 (a step 106), the washing process starts. When the feed water amount is 30 L, the hardness of the washing water which has been supplied into the drum 7 is about 38 ppm, as shown in ● mark in FIG. 16. With this hardness, the surfactant in the detergent acts effectively to dislodge the dirt, and compared to the washing using the water of 300 ppm, the cleaning rate can be improved remarkably (confer FIG. 10). Further, the insoluble metallic soap, which is generated by reaction of the hardness component with the surfactant in the detergent, is hardly generated. Further, the detergency similar to the case in which the conventional drum type washing machine use hot water of 60° C. can be obtained, and, accordingly, the electric power and the time (the time for obtaining the hot water) can be saved and it is useful for the energy saving.

The supply of water in the step 104 has finished, the normal and reverse rotation (the step 106) of the drum 7 starts, and, at the substantially the same time ,the microprocessor 66 operates to open the salt / feed water electromagnetic valve 28*b* for a short time, so that a first amount of water is supplied to the salt vessel 42 (a step 107). The water amount is 70–80 mL. A control of the water amount is carried out by controlling the opening time of the salt / feed water electromagnetic valve 28*b* similar to the above.

The water 60*a* is accumulated in a bottom portion of the salt water vessel 42, and the water surface thereof reaches a height h1 from the bottom of the salt water vessel 42. This is performed so that the height of the drainage-pipe 46*b* of the siphon 46, which is arranged in the bottom portion of the salt water vessel 42, is established so as to be higher than the above-stated height h1. The sizes of the salt water vessel 42 and the salt vessel 45 in this embodiment according to the present invention, under the above-stated water condition, the height h1 becomes from 7 mm to 10mm. An interval of the mesh filter 45*c* of the bottom face of the salt water vessel 42 and the bottom face of the salt vessel 45 is 4 mm–6 mm, as stated above, the mesh filter 45*c* is set lower than the water surface. Accordingly, the salt is dissolved through the mesh filter 45*c,* and the salt concentration of the water increases. During the normal and reverse rotation of the drum, the salt concentration is raised up by about 20%. At this time, in the above-stated water containing process, the salt contains the water then the salt does not absorb the first water. When there is no water containing process and the salt is dry, almost all of the first water is absorbed to the salt, and it is impossible to generate salt water having a concentration of about 20%.

When the normal and reverse rotation of the drum 7 in the step 106 has finished and the washing process has finished, the microprocessor 66 will operate the drainage pump 24 (a step 108), and the draining of the washing water in the outer tub 3 is started. And, at the same time as the operation of the drainage pump 24, the regeneration water discharging valve 44 is opened (a step 109). The water which remains in the cylindrical vessel 41 begins to discharge from the regeneration water discharging port 41*c,* through the regeneration water discharging valve 44 and a drainage tube 58. Further, when the regeneration water discharging valve 44 is opened, water does not exist in the drainage tube 58, and so the discharging speed of the water in the cylindrical vessel 41 becomes very slow. The reasons why is that discharge of the water occurs in response to gravity, however, between the upper portion and the lower portion of the cylindrical vessel 41, the difference between water levels is small. To smoothly perform the regeneration stated above, it is necessary to fill up the drainage tube 58 with water before the regeneration. Accordingly, at the same time as the opening of the regeneration water discharging valve 44, the feed water electromagnetic valve 28*b* is opened for a short time, and a preliminary feed of the water is carried out. Then, the water passes the drainage tube 58 from the lower space 49 and flows until the water fills up the drainage tube 58. For these reasons, a difference of the water level can be established between the water surface of the upper space 50 and an outlet port of the drainage tube 58, and, accordingly, the water in the cylindrical vessel 41 can be discharged smoothly.

Before the water in the upper space 50 is used up (from the opening of the regeneration water discharging valve 44, about 10–20 seconds), the salt / feed water electromagnetic valve 28*b* is opened, a second supply of water is carried out in the salt water vessel 42 (a step 110). The water amount this time is 160–170 mL, and the control of the water amount is carried out according to the opening time of the salt / feed water electromagnetic valve 28*b,* similar to the above. In the salt water vessel 42, salt in the amount of about 20 grams is dissolved in the water in step 107, and a high concentration salt water having a concentration of about 20% is accumulated. During the second water, this salt water is diluted. Actually, since salt in the amount of about 5 grams is dissolved during the second supply of water, salt water having a concentration of about 10%, in which salt having a total of about 25 grams is dissolved, can be obtained.

According to the second supply of water, the water level in the salt water vessel 42 is raised up to a height h2, but since the water level exceeds the height of the drainage pipe 46*b* of the siphon 46, the salt water flows into the siphon 46 and through a hole 46at. Further, the gap 64*a* between the salt water vessel 42 and the side face of the salt vessel 45 is very small, the water level of the water h2 flows over, so that the salt water flows down to the water reservoir 65, and, as a result, the salt water is wasted. For this reason, it is preferable to set the gap 64*a* at 2–5 mm. The salt water from the hole 46*b* flows down into the upper space 50 because the check valve 53 opens and the regeneration (a step 111) of the ion exchange resin 51 begins. All of the salt water in the salt water vessel 42 flows down to the upper space 50 according to the function of the siphon 46. Further, it is preferable to set the gap 64*b* between the bottom face of the salt water vessel 42 and the salt vessel 45 at more than 3 mm. The reason for this is that, when the gap 64*b* is being narrow, the force according to the surface tension of the salt water is greater than the force according to the hydraulic head of the siphon 46 and air does not enter the gap 64*b,* whereby much salt water remains in the gap 64*b* and it is impossible for almost all of the salt water to flow down.

When the salt water flows down into the upper space 50, the resin chamber 52, the lower portion space 49 and the drainage tube 58 are filled up by the water. For this reason, the salt water can pass easily through the ion exchange resin 51 layer according to the difference in the water level between the outlet port 23 of the drainage tube 58 and the salt water surface of the upper space 50. In other words, since only the force of gravity is needed for the salt water to flow to the ion exchange resin 51, it is unnecessary to use a specific motive force, and the regeneration mechanism of the ion exchange resin 51 can be realized with a compact structure and at a low cost. Since the salt water flows in the ion exchange resin 51, the reaction occurs from the left side to the right side of the chemical formula 1 and the chemical formula 2, and the hardness component, such as the calcium ions and the magnesium ions, which have undergone ion exchange during the feed of water, and the sodium ions in the salt water are replaced, the ion exchange resin is regenerated (a step 111). Therefore, the ion exchange ability of the ion exchange resin 51 is recovered, and it can be utilized for the next feed water time. With the above stated regeneration, the salt 57 in the salt vessel 45 is consumed by about 25 grams each time, and so the salt is reduced gradually. In this embodiment according to the present invention, the amount of salt is about 500 grams, so that the regeneration of the ion exchange resin can be carried out about twenty times without the need to supplement the supply salt.

The regeneration discharge water, which has passed through the ion exchange resin 51 and contains a large hardness component, comes out to the lower space 49 and passes through the regeneration water discharging valve 44 and the drainage tube 58 and enters into the drainage bellows 23 from the lower portion 23*a* of the drainage bellows 23. The regeneration discharge water is discharged from the drainage hose 25 by the drainage pump 24 together with the washing water during the water discharging. Accordingly, the regeneration discharge water does not come into contact directly with the stainless outer tub 3 or the drum 7, and so there is no concern for the occurrence of rust thereon. Further, since the regeneration discharge water does not contact the items being washed, there is no concern that the regeneration discharge water will be combined with the surfactant of the detergent which is absorbed and that a metallic soap will be left on the items being washed.

After the regeneration is completed in the step 111, between the ion exchange resins 51, the regeneration residual water according to the surface tension is left. In the regeneration residual water, a hardness component having a high concentration (several thousand ppm), which is separated from the ion exchange resin 51 in the regeneration, is left. When this residual water enters into the outer tub 3, the hardness is raised up about 5–10 ppm. Accordingly, to exclude this, the supply of cleaning feed water is carried out (a step 112). A following method will be carried out so as not to enter the regeneration residual water, which is excluded by the cleaning feed water in the outer tub 3.

The feed water electromagnetic valve 28*a* is opened for a short time and about 150 mL of water is supplied to the resin case 47 (a step 112). According to the feed water amount of 150 mL, the resin case 47 is filled up substantially by the water, but with this water amount, the water does not flow out to the reservoir 65. This water passes through the regeneration water discharge port 41*c* and is discharged to the drainage bellows 23 from the drainage tube 58. To discharge the water, since it takes about 20–30 seconds, during this time a waiting time is taken on (a step 114), and again the feed water electromagnetic valve 28*a* is made to open for a short time, so that about 150 mL of water is supplied to the resin case 47 (a step 112). From three times to five times, about 150 mL of water is supplied (a step 113). As stated above, by dividing into plural times the supply of water, so that small amounts are supplied to the ion exchange resin 51 and the water is discharged from the drainage tube 57, without the regeneration residual water entering into the outer tub 3, the cleaning of the ion exchange resin can 51 be carried out.

With the above, the regeneration of the ion exchange resin 51 is finished, and next the operation transfers to carry out a rinsing process. In the rinsing, number of rinsing cycle is established by the operator during the course establishment time. The microprocessor 66 repeats the established number of rinsing cycles (a step 115). All of the operations of the rinsing are the same, and so one cycle of the operations will be explained.

The microprocessor 66 carries out an intermediate spinning by rotating the drum 7 (a step 116). When the spinning has finished, the regeneration water discharge valve 44 is closed (a step 117), the feed water electromagnetic valve 28*a* is opened (a step 118), and the rinsing water is supplied into the outer tub 3 through the feed water passage, similar to the above-stated washing feed water. Since the ion exchange resin 51 has been regenerated already, the water to be supplied has already been softened. And, after the regular water amount is obtained, the feed water electromagnetic valve 28*a* is closed, and by rotating normally and reversibly the drum 7 (a step 109), the rinsing is carried out, and the detergent which has remained on the items being washed is washed out and diluted. When the feed water amount is 30 L, the leakage hardness on the discharge port 41 during the feed water changes from 18 ppm to 88 ppm, similarly to the above-stated washing feed water and as shown in mark of the range of the regeneration per every feed of water. The hardness of the rinsing water which is accumulated in the outer tub 3 becomes about 38 ppm as shown by the_marks.

Further, in the above stated explanation, after the finish of the regeneration process, an intermediate spinning is carried out, however it is necessary to have 3–4 minutes in the regeneration and the cleaning. For this reason, before the finish of the regeneration process, it is possible to start the intermediate spinning (a step 116). However, at the finish of the spinning, it is necessary to have the cleaning finished.

When the feed water electromagnetic valve 28*a* is closed and the drum 7 is made to rotate normally and reversibly and the rinsing is started, the microprocessor 66 carries out the regeneration process; The explanation of the regeneration process will be omitted because it is similar to that of the above-stated washing process.

As stated above, in this embodiment according to the present invention, when soft water is used as the rinsing water, the rinsing is carried out to exclude the dirty which is removed in the washing process and to lessen the detergent which has remained on the clothes. In the prior art, the rinsing is argued with the dilution of the detergent according to the rinsing water and it regards as important the detergent dilution rate in the rinsing water. However, the important thing is the detergent which remained actually on the clothes. Therefore, the detergent amount (the surfactant amount) which remained on the clothes after rinsing will be explained.

Figure 17:
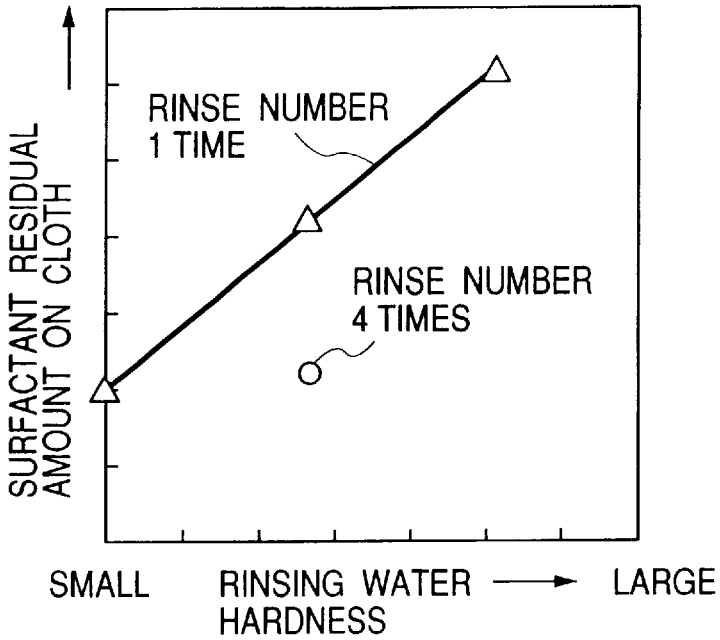
FIG. 17 is a graph showing a relationship between the rinsing water hardness and the surfactant residual amount on the clothes.

FIG. 17 shows a relationship between the hardness of the rinsing water and the amount of the surfactant which remains on the clothes after the rinsing. The kind of clothes is cotton and the number of rinsing cycles is one. As clearly understood from the figure, the rinsing water hardness and the surfactant residual amount are substantially in proportion, and the lower the hardness is, the lower will be the surfactant residual amount. The reasons for this are as following. During the washing time, the surfactant is adsorbed on the clothes. In the rinsing, the surfactant is diluted by the water and the surfactant is removed from the clothes; however, when the hardness of the water is high, the surfactant adsorbed on clothes and the hardness component are combined, so that a metallic soap is generated (hydrophilic nature of the surfactant and the hardness component are combined). This metallic soap is a substance which is hydrophobic in nature and is an insoluble material, so that they are not dissolved out in the rinsing water, but remain to adhere to the clothes, and, accordingly, there is a large surfactant residual amount on the clothes.

The residual amount of the surfactant can be reduced by increasing the number of rinsing cycles. For one example, the ○ mark in FIG. 17 represents the surfactant residual amount in the case of four times rinsing cycles. The surfactant residual amount is reduced to a degree similar to the case in which the rinsing is carried out one time with soft water. However, by increasing the number of rinsing cycles, since it is necessary to use much water and much time, it goes against the recent desires for energy saving. As stated above, since soft water is used for the rinsing, it is possible to remove efficiently the surfactant from the clothes.

Figure 18:
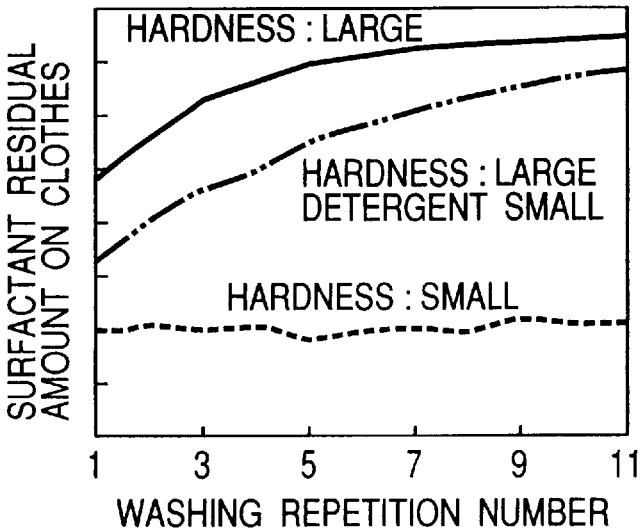
FIG. 18 is a graph showing a relationship between the washing repetition number and the surfactant residual amount on the clothes.

Further, when soft water is used in the rinsing, the following effects can be obtained. FIG. 18 shows a relationship between the repetition number of the washing (the washing, the rinsing, the spinning, the drying) and the surfactant residual amount in the clothes after drying. When the hardness is high (a said line), in proportion to the increase of the repetition number of the washing, the surfactant residual amount increases and is accumulates on the clothes. On the contrary, in soft water (a dashed line), there is hardly an increase of the surfactant residual amount. When a hardness component is contained in the water, by the repetition of the washing, an accumulation of the surfactant occurs. However, the amount of the surfactant which could be adsorbed onto the clothes is determined by the material of the clothes, and this amount is definite. For example, in cotton, the amount is large, but in a polyester material, the amount is small. Accordingly, the accumulation amount of the surfactant does not increase indefinitely, but will saturate at some washing time number.

By lessening the detergent amount, the initial period accumulation amount of the surfactant can be lessened. However, as shown by a two-dot chain line in FIG. 18, when the accumulation amount per one washing time is small, in proportion to the increase of the repetition number, the residual amount increases and the difference with the ordinary detergent amount becomes little. Accordingly, taking into consideration the accumulation of the surfactant, it is better to use soft water. This preference resides in the fact that, as stated above, the surfactant adsorption amount up to the clothes is definite, when the detergent amount is small, the surfactant adsorbs this amount. Accordingly, by the use of soft water, the accumulation of the surfactant residual amount due to the washing repetition can be prevented.

As stated above, the use of soft water for rinsing is very useful to remove efficiently the surfactant from the clothes. In particular, in a drum type washing machine, the amount of water being used is small, since a number of rinsing cycles are carried out. As a result, there is a tendency to use much water. However, by the use of soft water, even with a small number of rinsing cycles (a small water amount) the rinsing performance can be obtained fully.

When the surfactant which remains on the clothes is lessened, for people who have allergic contact conjunctivitis and a weak skin, it is possible to lessen to some extent the causes of the allergy. Further, when rinsing is carried out using water having a high hardness, as stated above, the surfactant which remains on the clothes generates a metallic soap. Since the surfactant adheres to the clothes after the drying, it leads to a stiff feeling of the clothes, and there is a problem in that the feeling and the drape and the handling of the cloth are damaged. However, since the clothes are washed using soft water, which is also used in the rinsing, the effect in which the clothes have a softened finish can be obtained. Further, the surfactant which remains on the clothes is one cause of yellowing (in particular, the case of a natural soap), but the invention has an effect for preventing such a yellowing.

When the rinsing process having some number of cycles which is established by the operator has finished (a step 115), the microprocessor 66 operates to rotate the drum 7 in one direction and carries out a spinning process (a step 120). And, the regeneration water discharge valve 44 is closed, the drainage pump 24 is stopped (a step 121), the lid lock means 70 is released and the washing is finished (a step 122).

In this embodiment according to the present invention, during the feed water time, the water flows from the lower portion of the resin exchange 51 layer direct to the upper portion and during the regeneration time reversibly the salt water flows into to the lower portion (during the feed water time and the during the regeneration time, the flow direction is reversible). The reason why the salt water flows into the lower portion only by utilizing the difference in level between the surface of the salt water in the cylindrical vessel 41 and the water surface in the outer tub 3, is because the salt water can be made to flow by the force of gravity, thereby the structure of the ion removal means 41 can be simplified. Further, as stated above, since the salt water can be accumulated in the upper space 50, the salt water can flow uniformly in the ion exchange resin 51, and, accordingly, the regeneration of the salt water can be carried out efficiently.

The reason why the feed water flows into the upper portion is that, when the feed water flows from the upper space 50 to the lower space 49, in the upper space 50 the city water pressure (0.029–0.78 MPa) acts, so it is necessary to endure the check valve 53 to the above stated pressure, and this leads to a complication in the structure and a lowering in the reliability. Further, when the discharge port is arranged in the lower space 49, after the feed of water is finished, the water in the lower space 49 is discharged immediately and it is impossible for the salt water to flow down using only by the difference in the water level. Further, since the gap is provided in the resin chamber 52, the ion exchange resin 51 is stirred in the resin chamber 52 during the feed water start time and during the feed water stop time, and foreign matter which has entered into the ion exchange resin 51 are excluded to the outside of the resin chamber 52, therefore clogging does not occur. On the other hand, when the feed water flows from the upper portion to the lower portion, since the ion exchange resin 51 is not stirred, foreign matter tends to accumulate on the ion exchange resin 51, and there is a large possibility of the occurrence of clogging.

Herein, the effect of the mesh filter 45*g* of the side face of the salt vessel 45 will be explained. As stated already above, commonly the salt 57 in the salt vessel 45 contains water. The salt 57 containing water solidifies from the surface as time lapses. In this case, when the side face of the salt vessel 45 forms a wall through which the water will not pass, the salt adheres to the wall. The dissolved salt is carried through the mesh filter 45*c* of the bottom face of the salt vessel 45 and the amount thereof reduces gradually. However, when the salt adheres to the wall face, the salt can not flows down to the lower portion and a space is formed between the mesh filter 45*c* and the salt grows up. Finally, the amount of salt which contacts the mesh filter 45*c* become very little, therefore it is impossible to carry out the production of salt water having a high concentration.

However, as shown in this embodiment according to the present invention, when the mesh filter 45*g* is provided on the side face of the salt vessel 45, and, further, a gap 64*a* is provided between salt vessel 45 and the side face of the salt water vessel 42, by the feed of water through the salt / feed water electromagnetic valve 28*b* in the step 110, when the surface of the water in the salt water vessel 42 is raised to the height h2, the water enters from the gap 64 through the mesh filter 45*g* of the side face of the salt vessel 45 and the small amount of salt which contacts the mesh filter 45*g* of the side face of the salt vessel 45 is carried out so as to be dissolved, whereby a gap is formed between the mesh filter 45*g* and the salt 57. For this reason, there is no adhesion between the salt 57 and the salt vessel 45. The salt drops down with the part involved in the dissolution, whereby the condition in which the salt is always in contact with the mesh filter 45*c* of the bottom face can be maintained. Accordingly, the salt water can be generated stably. Further, it is preferable to make the gap 64*a* as small as possible to achieve a compact size apparatus, but it is preferable to set it to 2–5 mm taking into consideration easy attachment and easy detachment of the salt vessel 45 relative to the salt water vessel 42.

Next, the advantages of using the siphon 46 to discharge the salt water from the salt water vessel 42 will be explained. With use of the siphon 46, during the regeneration time, since all of the water in the salt water vessel 42 is discharged, after the regeneration is finished, the water hardly exists in the salt water vessel 42. Accordingly, the salt vessel 45 is not immersed in the water. When the salt residual amount become low and the salt is supplemented, the operator takes the salt vessel 45 out of the salt water vessel 42, and the operator can move the salt vessel 45 to a place in which the working can be done easily. In this case, when water remains in the salt vessel 45, during the transfer of the salt vessel 45, the water will drip out and soil the washing machine and the floor. However, the water remains only between the meshes of the mesh filter 45*c*. Further, in this embodiment according to the present invention, since the shape of the bottom portion of the salt vessel 45 is formed with a circular arc shape 45*h*, as shown in FIG. 8, or an inclined face, the water remaining in the frame part is prevented from coming out, unless the salt vessel 45 is intentionally swung, whereby the possibility of the water dripping out is very small.

As explained already above, in this embodiment according to the present invention, when salt in the amount of about 500 grams is placed in the salt vessel 45, the regeneration of the washing twenty times can be carried out automatically. In common, since the operator does not count the regeneration times, there is a concern that he or she may forget to supplement the supply of salt. Accordingly, the salt supplement indication means 36 is provided, so that the fact the amount of salt in the salt vessel 45 is low will be noticed by the operator. Herein, a method for detecting the existence of the salt will be explained as followings.

A first method is one in which the number of washings (the regeneration time number) is counted by the microprocessor 66, and when the count reaches a predetermined number, the salt supplement indication 36 is carried out. When the microprocessor 66 detects that the operator has completed the supplement of the salt and the salt supplement completion operation button 37 is pushed, then the counter is reset, and, at the same time, the salt supplement indication 36 is turned off. This method has a merit in that it is possible to realize detection without use of a specific sensor, and detection can be obtained at a low cost.

A second method is one in which the residual amount of the salt 57 is detected, and when it becomes less than the regular amount, the salt supplement indication 36 is carried out. This method has a merit in that regardless of the amount of the salt for supplementing by the operator, the indication of the non-existence of the salt can be carried out surely. To detect of the salt residual amount, a method for measuring the mass of the actual salt residual amount is the most simple method. For example, this can be done by providing a sensor, such a load cell for measuring the mass of the salt vessel 45, at the bottom portion of the salt water vessel 42.

The above-stated mass measurement has another effect, in that, in response to the supplement amount of the salt by the operator, the water amount during the water containing operation time can be controlled. When the amount of the salt to be supplemented by the operator is about 500 grams, the water amount for carrying out the water containing operation is 120–130 mL. However, when the amount of the salt to be supplemented is less than the above stated amount, with a water amount of the 120–130 mL, the water supply becomes excessive.

For example, when the supplement amount of the salt is 300 grams, under the above stated water amount, water of about 50 mL is not absorbed and remains in the salt water vessel 42. Herein, to generate salt water having a high concentration, in the first water, when 70–80 mL of water is supplied, through the siphon 46, almost all of the salt is not melted, but flows down to the upper space 50. For this reason, the salt water having a high concentration can not be generated and the regeneration of the ion exchange resin 51 is not carried out fully. However, when the amount of the supplemented salt is detected through the load cell, since it is possible to supply the water amount corresponding to the above stated salt amount, the problems stated above can be prevented.

Further, it is possible to carry out detection of the salt residual amount by measuring the salt water concentration using an electric conductivity cell, for example. When the salt water concentration becomes less than a predetermined value, the salt supplement indication 36 is carried out. The measurement of the salt water concentration can be used to ensure that the generated salt content concentration is controlled substantially constant. Accordingly, salt water having a concentration of 10%, which has a good regeneration efficiency, can be used always for the regeneration.

In the above stated embodiment according to the present invention, since the regeneration of the ion exchange resin is carried out every time water is supplied, the hardness of the water during the washing and during the rinsing is made less than 40 ppm. However, even when the hardness of the water used for rinsing is high, this has no affect on the detergency. Herein, the regeneration of the ion exchange resin can be carried out after the final rinsing. With this manner, the washing water can always be soft water.

Further, when it is used without the supplement of the salt, the ion exchange resin loses completely the hardness removal ability. In this case, when it is intended to carry out washing using soft water, it is necessary to regenerate the ion exchange resin before the feed of the water. This can be realized by altering a little the operation flow shown in FIG. 15 as follows. For example, when the start switch 34*a* and the salt supplement completion button 37 are pushed at the same time, before the feed of water, it is programmed to carry out the regeneration.

When the operator pushes the start button 34*a* and the salt supplement completion button 37 at the same time, before the feed of water, the regeneration mode is initiated. After the salt supplement, without the feed water in the step 104, first of all the water containing process (a step 126) is carried out. After that, the regeneration process from the step 107 is carried out. In this case, as to the interval between the first supply of water in the step 107 and the second supply of water in the step 110, it is necessary to have an interval of at least one minute, preferably three minutes. This is needed for making the salt water having a high concentration in the first supply water. The salt water having a concentration of about 15% can be generated, but at three minutes salt water having a concentration of about 20% can be generated. When the regeneration process has finished, from the opening of the feed water electromagnetic valve 28*a* in the step 104, the process returns the ordinary operation flow. In this manner, the washing water can be converted to soft water.

With the above, assuming a case in which the hardness of the city water is 300 ppm and the feed water amount is 30 L, the embodiment according to the present invention will be explained. However, in actual practice, according to the place where the washing machine is used, the hardness of the city water will vary. For example, in the case in which of the hardness of the city water is 100 ppm, the hardness of the washing water during the 30 L feed water time to the outer tub 3 is about 6 ppm, accordingly, it is unnecessary to regenerate immediately the ion exchange resin. When the feed water amount is 30 L in all cases, in the four times water is supplied, the hardness becomes about 40 ppm. When the washing is one time and the rinsing is two times, the regeneration during the washing process can be carried out one time after the finish of rinsing. Therefore, according to the hardness of the city water, since the regeneration interval of the ion exchange resin is determined, wasteful consumption of the salt can be restrained.

Hereinafter, one embodiment according to the present invention will be explained.

In FIG. 14, a reference numeral 72 indicates an EEPROM which is a non-volatile memory in which a program is stored to carry out the control required in accordance with this invention.

The relationship between the hardness of the city water and the hardness removing performance of the ion exchange resin is known in advance, and the washing machine is made to store this relationship in EEPROM 72. More specifically, the relationship shown in FIG. 16 is stored for plural hardness conditions. In other words, the relationship between the hardness of the city water and the water amount to be processed is stored.

However, to utilize the above-stated relationships, it is necessary to know the hardness of the city water. As a means for knowing the hardness, there are the following methods.

The most sure method is provide a hardness measurement means in to the feed water passage upstream from the ion exchange removal means 40. As the hardness measurement means, there are a method for measuring the calcium ion concentration and the sodium ion concentration and a method for measuring the electric conductivity degree. In these methods, since the hardness of the water to be used is measured directly, it is possible to carry out a minute control. In accordance with the measured hardness and the used water amount, by utilizing the above-stated relationships, the regeneration timing of the ion exchange resin is determined, and only the necessary time for regeneration is carried out.

However, in this method, since it is necessary to provide the electrode and the electric circuit, the cost of the washing machine is increased a little.

A more simple method is a method in which a commercial hardness indication chemical is used. When the user starts to use the washing machine, by using this indication chemical, the user measures the hardness of the city water to be used. And, the value is stored in the EEPROM. This is performed by pushing the start button 34*a* and the door open button 34*c* at the same time, which places the microprocessor 66 in the hardness input mode, and the data input is carried out in accordance with the number of times the course selection button 34*b* is pushed. For example, the case of one actuation of button 34*b*, less than 50 ppm is indicated, and in the case of two actuations, 50–100 ppm is indicated, and the like.

Another simple method is one in which the information about the area (telephone number or zip code number) where the washing machine is used is utilized. In ordinary circumstances, the city water is supplied from a filtration plant which is equipped by a city, town, or village. Accordingly, in a particular area, the water is supplied from the same filtration plant. The hardness of the filtration can be determined from the water quantity research results which are carried out periodically at the filtration plant. Accordingly, the washing machine manufacturer stores the relationship between the area information and the city water hardness of the filtration plant in the EEPROM. At the initial stage of the use of the washing machine, the area information is input according to the operation of the button 34.

In EEPROM 72, the target hardness of the water which is subjected to use in the washing and/or the rinsing is stored by the washing machine manufacturer or the user. The microprocessor 66 will request the hardness removing performance of the ion exchange resin by using the relationship shown in FIG. 16 according to the city water hardness value stored by the above-stated measurement or the storing and the water amount which has been supplied actually and to calculate the hardness of the water (the washing water or the rinsing water) which has accumulated in the outer tub 3. Ordinarily, since the washing water amount and the rinsing water amount are substantially the same, the hardness of the water in the outer tub 3 can be anticipated during the feed water time. By comparing this anticipated value with a previously stored value, when it exceeds the target hardness, before the next feed water time, the regeneration process of the ion exchange resin is carried out similar to the method explained with reference to FIG. 15.

Figure 19:
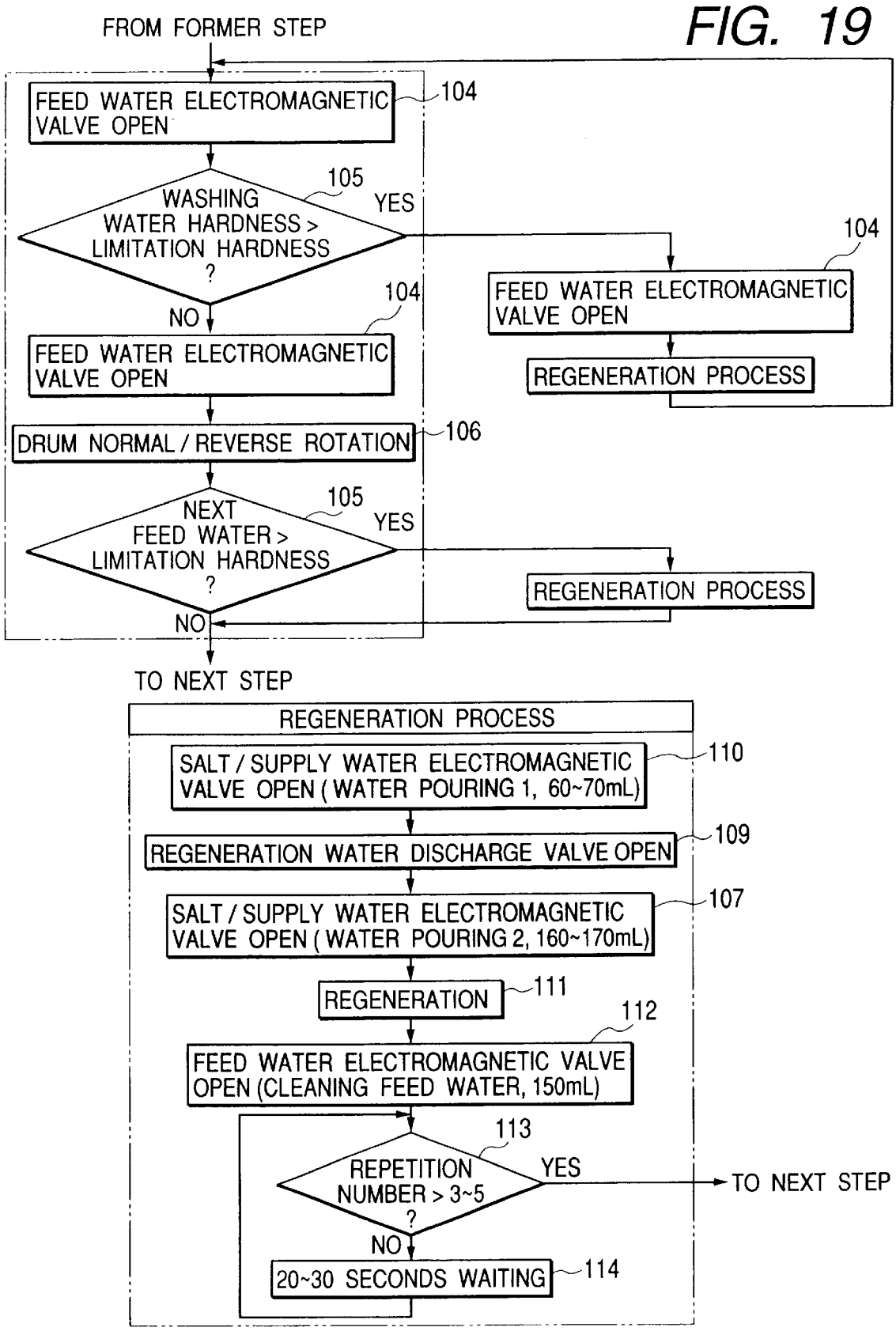
FIG. 19 is an operation flow chart of the drum type washing machine in FIG. 1.

The operation flow chart is shown in FIG. 19. In this operation flow chart, only the part relating to the feed of water and the part relating to the regeneration will be explained. The microprocessor 66 is made to open the feed water electromagnetic valve 28*b* (a step 131) and the feed of water to the outer tub 3 is started. The microprocessor 66 watches the feed water rate according to the water level sensor 27. On the other hand, in the EEPROM, the target hardness value of the water which is accumulated in the outer tub 3, and the relationship between the city water hardness, the feed water amount and the hardness of the ion exchange resin, are written in in advance. The microprocessor 66 calculates the hardness of the water which is accumulated in the outer tub 3 from these relations, and compares the calculated hardness with the target hardness (a step 132).

Figure 20:
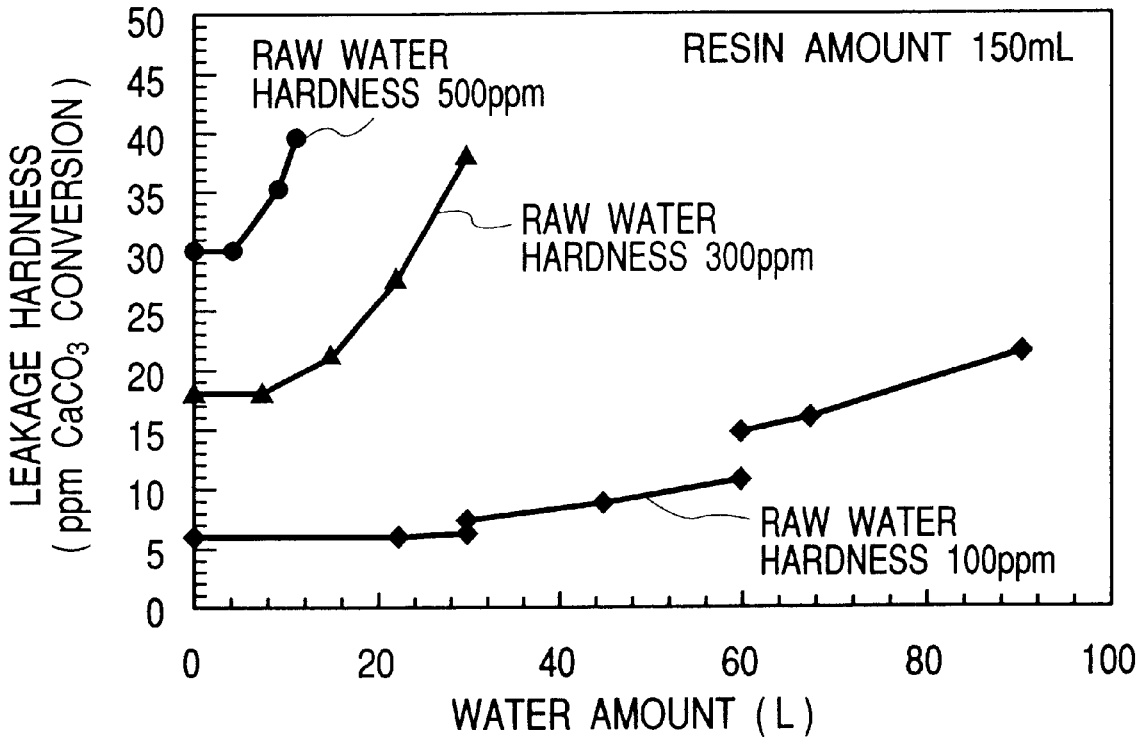
FIG. 20 is a graph showing a relationship between the water amount bed of the ion removal means of FIG. 6, the washing water hardness, and the city water hardness.

FIG. 20 shows the feed water amount and the hardness of the water (it is expressed as the washing water) which is accumulated in the outer tub 3. In this figure, as one example, the cases of the city water hardness of 100 ppm, 300 ppm and 500 ppm are shown. For example, in the case of the city water hardness of 500 ppm, at the feed water amount of about 10 L, since it reaches the target hardness, the microprocessor 66 is made to close the feed water electromagnetic valve 28*b* and then the feed of water is stopped. And, the regeneration process of the ion exchange resin is carried out. The details of the regeneration process are shown at a lower portion of FIG. 20, but this is the same method as was explained with reference to FIG. 15. When the regeneration process has finished, the feed water electromagnetic valve 28*b* is opened again and the feed of water starts.

Further, as shown in the above-stated embodiment, in the case when regeneration process is carried out midway of the feed of water, the regeneration drainage which contains a large hardness component does not flow in the outer tub 3. For this, a drainage valve is provided between the drainage bellows 23 and the drainage pump 24 and it is necessary to connect the drainage tube 58 on a downstream side from this drainage valve. Accordingly, during the feed water time, the washing time, and the rinsing time, since the drainage valve is closed, the regeneration drainage does not flow into the outer tub 3. Further, in the case where the drainage valve is not provided, it may be constituted that the drainage tube 58 is taken out to the outside of the washing machine and is connected to the outlet port 25*a* of the drainage hose 25. Since the outlet port 25*a* is arranged in a lower portion of the drainage hose 25, the regeneration drainage does not flow into the outer tub 3 by the formation of a reverse flow.

The microprocessor 66, which has noticed that the water of a regular amount has accumulated in the outer tub 3 through a signal from the water level sensor 27, operates to close the feed water electromagnetic valve 28*b* and to rotate normally and reversibly the drum 7, so that washing or rinsing starts. For example, in the case of the feed water amount of 30 L, under the city water hardness of 500 ppm, in the midway of the feed of water, it is necessary to carry out the regeneration process two times, but under the city water hardness of 300 ppm and 100 ppm, in the midway of the feed of water, it is unnecessary to carry out the regeneration process.

When the washing or the rinsing starts, the microprocessor 66 estimates whether, at the next feed water time, the water in the outer tub 3 exceeds the limitation hardness or not (a step 135). For example, in the cases of the city water hardness of 300 ppm, 500 ppm shown in FIG. 20, as the water is near to the limitation hardness, it is necessary to carry out the regeneration, but in the case of the city water hardness of 100 ppm, it is unnecessary to carry out the regeneration. When the regeneration is to be carried out, the regeneration process in a step 138 is carried out.

As stated above, according to the city water hardness and the feed water amount, since the regeneration interval of the ion exchange resin is determined, when the hardness removal ability of the ion exchange resin is sufficient, the regeneration is not carried out. Accordingly, the wasteful consumption of the salt and the time for carrying out the regeneration can be saved. Further, to obtain water having a hardness of less than 400 ppm from water with a high hardness, such as 500 ppm, ordinarily, in the case of the feed water amount of 30 L, it is necessary to have the ion exchange resin of about 300 mL, whereby the ion removal means becomes large, accordingly, the installation to the washing machine becomes difficult. However, as stated above, in the midway of the feed of water, since the feed of water is stopped and the regeneration is carried out, even if the amount of the ion exchange resin is small, it is possible to obtain soft water from city water having a high hardness. Accordingly, it is possible to realize a small size ion removal means which can be installed in the inner portion of the washing machine. Accordingly, even in the area where almost all hard water is less than 100 ppm, such as in Japan, even in an area where hard water of 300–500 ppm, such as in Europe and United States of America, the same ion removal means can be used.

In to the home, hot water from the hot water supply means is supplied directly to the washing machine. In this case, the hot water flows in the ion exchange resin. The heat withstanding temperature of the ion exchange resin is generally more than 100° C. At 60° C. degree, which is used in a washing in the washing machine, the ion exchange resin is not deteriorated early. In the case of a boiling cleaning operation, in which a main aim is to carry out a disinfecting of the items to be washed out, hot water having a high temperature of 80–95° C. is supplied. In the case where such hot water is used during a long period, there is a concern for deterioration of the base substance of the ion exchange resin. Accordingly, by providing a water temperature detection means to detect the temperature of the water to be supplied, in the case of water having more than the regular temperature, it is better to not supply the water to the ion exchange resin by shutting off the feed water. The shut-off can be carried out by closing the feed water electromagnetic valve 28*b*. In the boiling cleaning operation, by the use of an electric heater which is installed in the drum type washing machine, the water temperature can be raised. Further, in the case where the water temperature is more than the regular temperature, the feed water need not be shut off, but by providing a bypass passage of the ion exchange resin (the ion removal means), the feed water can be supplied to the water reservoir by passing through the bypass passage.

Further, FIGS. 10, 11, 12, 13, 16, 17, 18 and 20 used in the above-stated explanation are formed according to experimentation performed by the present inventors.

In the above-stated explanation, a drum type washing machine is described as an example, however the invention can employ anther type of washing machine in which the rotation axis of the washing tub is arranged in a vertical direction, and in which clothes opening and lid thereof are provided at an upper portion, or to a further type washing machine in which a rotation axis in a washing tub is inclined at any angle from the vertical to the horizontal.

According to the present invention, the raw material having the ion exchange ability can be constituted compact, the amount of the regeneration agent used is able to carry out plural times of the regeneration, and for the purpose of the mounting the raw material on the drum type washing machine, for every washing process, every rinsing process, or in the midway of the feed of water, the feed water is stopped once, it is possible to use automatically the raw material by carrying out the regeneration process. Accordingly, in city water of any hardness, without use of hot water, a drum type washing machine having a high detergency can be provided.

What is claimed is:

1. In a washing machine having a washing tub for receiving a washing matter and for carrying out a washing, a feed water means for supplying water to said washing tub, a regeneration means for regenerating an ion removal means disposed for regenerating ions contained in the water supplied by said feed water means, and a drainage means for discharging water from an inner portion of said washing tub, the washing machine characterized in that said feed water means comprises a feed water valve and a vessel for supplying a detergent in a downstream side of said feed water valve, said ion removal means being disposed between said feed water valve and said vessel for supplying a detergent;

wherein water from said feed water valve travels through said ion removal means, and then through said vessel for supplying a detergent for at least initially supplying water with detergent into said washing tub, and wherein said regeneration means regenerates said ion removal means prior to a rinsing portion of said washing.

2. In a washing machine having a washing tub for carrying out a washing, a feed water means for supplying water to said washing tub, a drainage means for discharging water from an inner portion of said washing tub, and a control means for each process of said washing, the washing machine characterized in that said feed water means comprises a feed water valve, a pour water reservoir, a detergent supply case provided with respect to said pour water reservoir, a pour water pipe for connecting said pour water reservoir and said washing tub, and an ion removal means for removing ions which are contained in said feed water, and regeneration means for regenerating said ion removal means in a regeneration process, said ion removal means being provided between said feed water valve and said detergent supply case;

wherein said washing includes a first feedwater supply process in which said feed water means supplies water and stops the supply of the water, a first washing process, a second feedwater supply process in which the feed water means is restarted to resupply water, a second washing process, and a regeneration process occurring between said first washing process and said second washing process in which said regeneration means operates for regenerating said ion removal means.

3. In a washing machine having a washing tub for carrying out a washing, a feed water means for supplying water to said washing tub, and a drainage means for discharging water of an inner portion of said washing tub, the washing machine characterized in that said feed water means comprises a feed water valve, a pour water case, a detergent throw-in case provided on said pour water case, a pour water pipe for connecting said pour water case and said washing tub, and an ion removal means for removing ions which are contained in the feed water, and said ion removal means is provided on an upper portion of said washing tub.

4. In a washing machine having a washing tub for carrying out a washing, a first feed water means for supplying water to said washing tub, and a drainage means for discharging water of an inner portion of said washing tub, the washing machine characterized in that said feed water means comprises a feed water valve, a pour water case, a detergent throw-in case provided on at inner portion of said pour water case and enable for attaching, a pour water pipe for connecting said water case and said washing tub, and an ion removal means for removing the ions which are contained in the feed water, and said ion removal means comprises a resin vessel in which an ion exchange resin is filled up, a regeneration agent vessel for receiving a regeneration agent which regenerates an ion removal function of said ion exchange resin, a regeneration water vessel arranged at an upper portion of said resin vessel and for arranging said regeneration agent vessel in an inner portion thereof and for storing a regeneration water having a regular concentration which is generated by dissolving said regeneration agent having a substantially regular amount from said regeneration agent to the water which is supplied from a second feed water means, a passage provided at a bottom portion of said regeneration water vessel by passing through a bottom face of said pour water means and communicated with said resin vessel and for flowing down said stored regeneration water into said resin vessel, and a regeneration water discharge passage for connecting said bottom portion of said resin vessel and said drainage means, and said regeneration water vessel is arranged in an inner portion of said detergent throw-in case.

* * * * *